US009970606B2

(12) United States Patent
Grigore

(10) Patent No.: US 9,970,606 B2
(45) Date of Patent: May 15, 2018

(54) ELONGATED L.E.D. LIGHTING SYSTEMS, MANUFACTURING AND METHODS TO CONFIGURE THE SAME

(71) Applicant: Valerica Grigore, Longmont, CO (US)

(72) Inventor: Valerica Grigore, Longmont, CO (US)

( * ) Notice: Subject to any disclaimer, the term of this patent is extended or adjusted under 35 U.S.C. 154(b) by 201 days.

(21) Appl. No.: 14/810,714

(22) Filed: Jul. 28, 2015

(65) Prior Publication Data

US 2016/0033117 A1 Feb. 4, 2016

Related U.S. Application Data

(63) Continuation-in-part of application No. 14/672,146, filed on Mar. 28, 2015.

(60) Provisional application No. 62/031,734, filed on Jul. 31, 2014.

(51) Int. Cl.

| | |
|---|---|
| ***F21S 4/28*** | (2016.01) |
| ***F21V 33/00*** | (2006.01) |
| ***F21S 8/02*** | (2006.01) |
| ***F21V 23/00*** | (2015.01) |
| *E04F 13/14* | (2006.01) |
| *F21Y 115/10* | (2016.01) |

(52) U.S. Cl.

CPC . *F21S 4/28* (2016.01); *F21S 8/02* (2013.01); *F21V 23/007* (2013.01); *F21V 33/006* (2013.01); *E04F 13/141* (2013.01); *F21Y 2115/10* (2016.08); *Y10T 29/49002* (2015.01)

(58) Field of Classification Search

CPC .. F21S 4/28; F21S 8/02; F21V 23/007; F21V 33/006; F21V 29/74; F21V 17/002; F21V 23/009; Y10T 29/49002; Y10T 29/49119; F21Y 2115/10; F21Y 2101/00; E04F 13/141

See application file for complete search history.

(56) References Cited

U.S. PATENT DOCUMENTS

| | | | |
|---|---|---|---|
| 7,178,941 | B2 | 2/2007 | Roberge et al. |
| 7,296,912 | B2 | 11/2007 | Beauchamp |
| 7,494,258 | B2 | 2/2009 | McNaught |
| 7,658,506 | B2 | 2/2010 | Dowling |
| 7,914,171 | B2 | 3/2011 | Fabbri et al. |
| 8,235,539 | B2 | 8/2012 | Thomas et al. |
| 8,382,314 | B2 | 2/2013 | Ou et al. |
| 8,613,525 | B2 | 12/2013 | Shimizu et al. |
| 8,746,933 | B2 | 6/2014 | Cho et al. |
| 8,764,220 | B2 | 7/2014 | Chan et al. |
| 8,777,448 | B2 | 7/2014 | Shimizu et al. |
| 8,820,964 | B2 | 9/2014 | Gould |
| 8,864,332 | B2 | 10/2014 | Ter-Hovhannisyan |
| 8,888,306 | B2 | 11/2014 | Thomas et al. |
| 8,888,335 | B2 | 11/2014 | Wang |
| 8,926,126 | B2 | 1/2015 | Ronen et al. |
| 8,955,998 | B2 | 2/2015 | Wong et al. |
| 8,956,005 | B2 | 2/2015 | Thomas et al. |
| 9,004,717 | B2 | 4/2015 | Ratkus et al. |
| 9,004,718 | B2 | 4/2015 | Myers et al. |
| 9,551,469 | B2 * | 1/2017 | Grigore ..... F21S 8/02 |

(Continued)

*Primary Examiner* — Bao Q Truong

(57) ABSTRACT

Elongated lighting fixtures intended to be incorporated into thin architectural surfaces, interconnected and configurable as a continuous run with potential to follow the direction of adjacent planar surface in three dimensional spaces while maintaining the structural integrity of the supporting framework.

13 Claims, 28 Drawing Sheets

(56) References Cited

U.S. PATENT DOCUMENTS

| | | | | |
|---|---|---|---|---|
| 2009/0207602 | A1* | 8/2009 | Reed | F21S 2/005 362/225 |
| 2011/0255276 | A1 | 10/2011 | Coward | |
| 2011/0273877 | A1 | 11/2011 | Reed et al. | |
| 2012/0268927 | A1 | 10/2012 | Saito et al. | |
| 2013/0272000 | A1 | 10/2013 | Pearson et al. | |
| 2014/0070724 | A1 | 3/2014 | Gould et al. | |
| 2014/0092596 | A1 | 4/2014 | Deutsch et al. | |
| 2014/0126196 | A1 | 5/2014 | Dixon et al. | |
| 2014/0177209 | A1 | 6/2014 | Carney et al. | |
| 2015/0138779 | A1 | 5/2015 | Livesay et al. | |

* cited by examiner

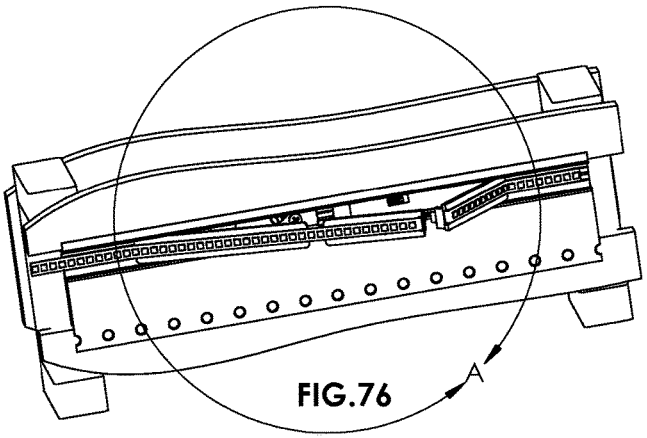
FIG.76
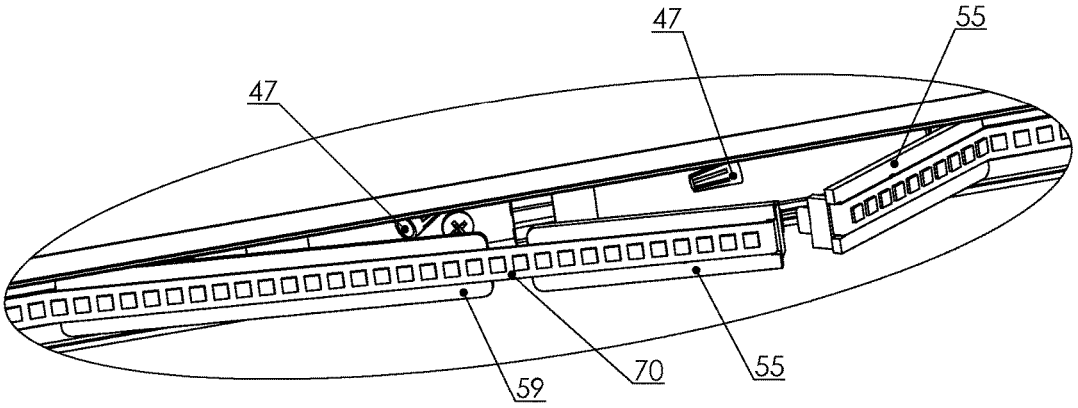
FIG.76-A

ELONGATED L.E.D. LIGHTING SYSTEMS, MANUFACTURING AND METHODS TO CONFIGURE THE SAME

CROSS REFERENCE TO RELATED APPLICATIONS

This application claims priority under 35 U.S.C. § 119 to U.S. Provisional Patent Application No. 62/031,734, titled "LINEAR L.E.D. LIGHTING SYSTEMS, MANUFACTURING AND METHODS TO CONFIGURE THE SAME", filed on Jul. 31, 2014. This application is a continuation-in-part of Utility application Ser. No. 14/672,146, titled "LINEAR LIGHTING SYSTEM, MANUFACTURING AND METHODS TO CONFIGURE THE SAME", and filed on Mar. 28, 2015.

BACKGROUND OF INVENTION

The majority of small form factor elongated lighting fixtures have their drivers in a remote location due to the fact that there is no room for integral drivers in those types of fixtures. These systems have performance losses caused by their long wires and are more difficult to install than integral driver fixtures.

The remote driver box fixtures are not U.L. approved for battery packs because most of the battery packs should be factory installed not field installed.

The installer have to drill thru every joist up to the last one near the fixture and route the electrical conduit from the remote driver compartment. This is additional labor and it would considerably increase the overall cost related to this job.

International residential building code prescribes limitations for notching and bored holes in both interior and exterior walls.

The decision about the location of the remote driver compartment is left to the installer and he can run into issues when he is limited by the length of the wire due to limitations imposed by manufacturer for power loss in the wire. He has to take extra steps to add up the segments of the wire way path and figure out the total length. In some situations he has to consult other people like the architect, designer, electrical engineer, building owner, contractors, etc. and incur delays due to these complexities.

For existent construction or remodeling there is a risk to interfere with electrical conduit runs, HVAC ducts or plumbing pipes as these are hidden inside the wall and most initial plans are not available or consulted before the work is started.

Those fixtures with integral driver compartment are designed as to allow driver access and maintenance, from the room side, but they require cutting and reframing structural members that are intended to support the walls and/or ceiling. This could extend or invalidate the building approvals required by the code or other authority therefore extending the overall lead time unnecessary.

Traditional shallow elongated recessed fixtures are not usually designed to allow access to replace the light engine while the maintenance of their remote drivers is more difficult than of those fixtures with integral driver.

The warranty for the L.E.D. driver is usually under 5 years while LEDs could have double that lifetime.

The power input of these runs is usually at the end of the fixture. Most of the walls and ceilings would have structural joist members at corner or at the end edges therefore these fixtures are not versatile and are not designed for what is mostly needed: end to end, transition corners, etc.

Most of the other fixtures could not be installed after the planar surface is up, on existent construction. Most of them are for new construction and to be installed before the planar surface is installed.

Various fixtures have been proposed to secure the light sources to the architectural surfaces. Typically, these fixtures have a relatively large depth profile that necessitates excessive clearance space behind the ceiling, wall, or floor surface. In most cases, it may be necessary to reframe a wall to add sufficient depth for the lighting fixture, which may also require cutting and reframing window sills, headers, and other architectural features for structural continuity.

Due to its housing depth and because it's installed to the structure with screws, the integral fixture opening is distorted making the opening variable along the length of the fixture which in turn is not accurate enough to install the light diffusing/converting optical elements like: extruded lens, covers, etc. Additional temporary brackets are used to brace and bridge this opening but they don't eliminate completely the effect and/or they don't control the cause of the distortion (deep housing profile, unknown screw torque force applied by the installed in the field).

SUMMARY OF THE INVENTION

The use of light as an element of design of architectural surfaces is a distinctive trend in modern times. In the near future more and more drivers will be integrated into the L.E.D. board. These are so called IC drivers. We can see that trend in direct line AC L.E.D. boards. These boards are connected directly to main power line without the need of a bulky driver to regulate them. Many consumers will want to convert their fixtures by upgrading their L.E.D. boards and this could eliminate one function of the driver compartment as being the enclosure for an L.E.D. driver but the enclosure will still be needed as storage compartment for the additional L.E.D. tape that is a result of using a tape that is not exactly the length of the concatenated run of fixtures. Also, the enclosure will be needed to contain the wire splices, wire nuts or the electrical connectors used to power the L.E.D. tape. This concept is designed to accommodate both, the current need for a driver compartment and the future upgrade. The future L.E.D. light engines could be housed and be powered directly from the power line integral to the small factor channel housing subject to this design.

In an exemplary embodiment of this invention, an elongated fixture system is designed to be installed without cutting of the structural joist members and could have any direction along the thin surfaces as well as it can be laid out to create formations of various shapes within these surfaces (for example resembling many if not all the capital letters in the alphabet), geometric figures, etc.

The applications of these fixtures are expanded to architectural accent lighting, general/ambient lighting for both, commercial and residential buildings.

The attached driver compartment option is designed to inherit the advantages of the integral fixtures and remove many of their disadvantages. For example a nearby driver would allow short wires between the L.E.D. board and driver therefore reducing considerably the power efficacy loss. The capability to access and replace a faulty driver is another advantage.

Another reason the traditional fixtures are 3" to 5" deep is due to the methods of mixing and diffusing L.E.D. light. The LEDs are oriented directly to the target therefore the point source is visible if it's too close to the lens. Advancements have been done relative to the optics, the diffuser lens are capable to blend the point source into a uniform, glare free, elongated source while allowing smaller distances between the diffuser surface and L.E.D. chips.

The light source could be remote phosphor style, traditional white L.E.D. or any other electroluminescent diode that is capable of generating radiation in response to an electrical signal. For example, the light source of a remote phosphor style would comprise of L.E.D.s installed on a printed circuit board (P.C.B.), that would emit blue light, namely a "blue pump" L.E.D, with the dominant wavelength ranging from 450 nm to 460 nm. Above the P.C.B., at a certain distance around the LED, there would be a material that contains phosphor that is intended to convert the wavelength of the photons emitted by the blue pump LEDs to white light spectrum. This phosphor material is separate and not packaged into the L.E.D. therefore it's known as "remote phosphor".

BRIEF DESCRIPTION OF THE DRAWINGS

The foregoing and other features and aspects of the invention are best understood with reference to the following description of certain exemplary embodiments, when read in conjunction with the accompanying drawings, wherein:

FIG. 14-A illustrates an isometric view of a gap created in a planar surface;

FIG. 16-A illustrates another isometric view of a gap created in a planar surface;

FIG. 18-A illustrates another isometric view of a gap created in a planar surface;

FIG. 28-A illustrates a side view of another light engine housing, component 13, in accordance with an exemplary embodiment of the present invention;

FIG. 28-B illustrates a side view of another light engine housing, component 14, in accordance with an exemplary embodiment of the present invention;

FIG. 54-A illustrates an isometric view of component 59, named 'power access cover', in accordance with an exemplary embodiment of the present invention;

FIG. 76 illustrates a perspective view of components of a line segment of a run of light fixtures installed in a planar surface, in accordance with an exemplary embodiment of the present invention;

FIG. 76-A illustrates a detail/partial view taken within the circle 'A', as labeled in FIG. 76, in accordance with an exemplary embodiment of the present invention;

Figure 1:
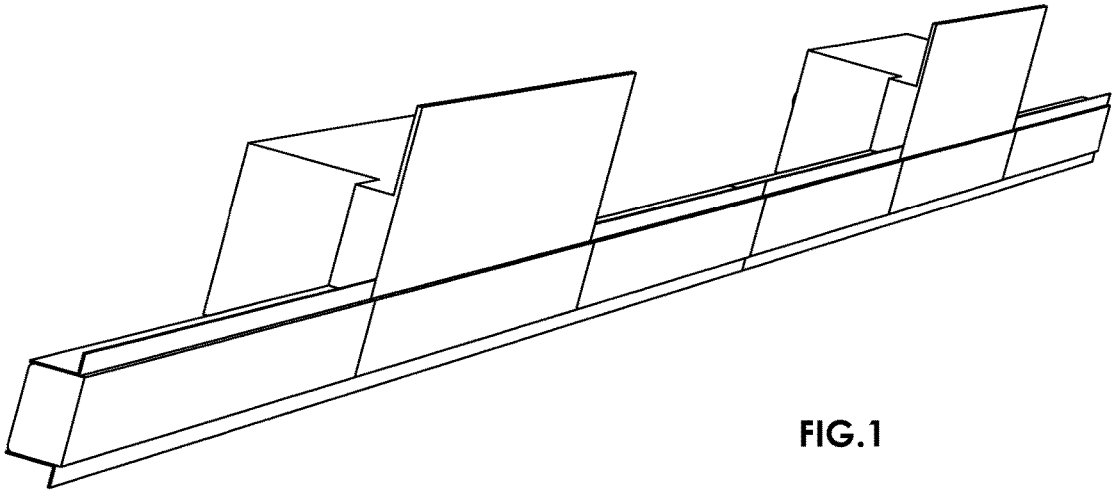
FIG. 1 illustrates an isometric view, frontal perspective, of a line segment of the embodied lighting system, in accordance with an exemplary embodiment of the present invention.
Figure 2:
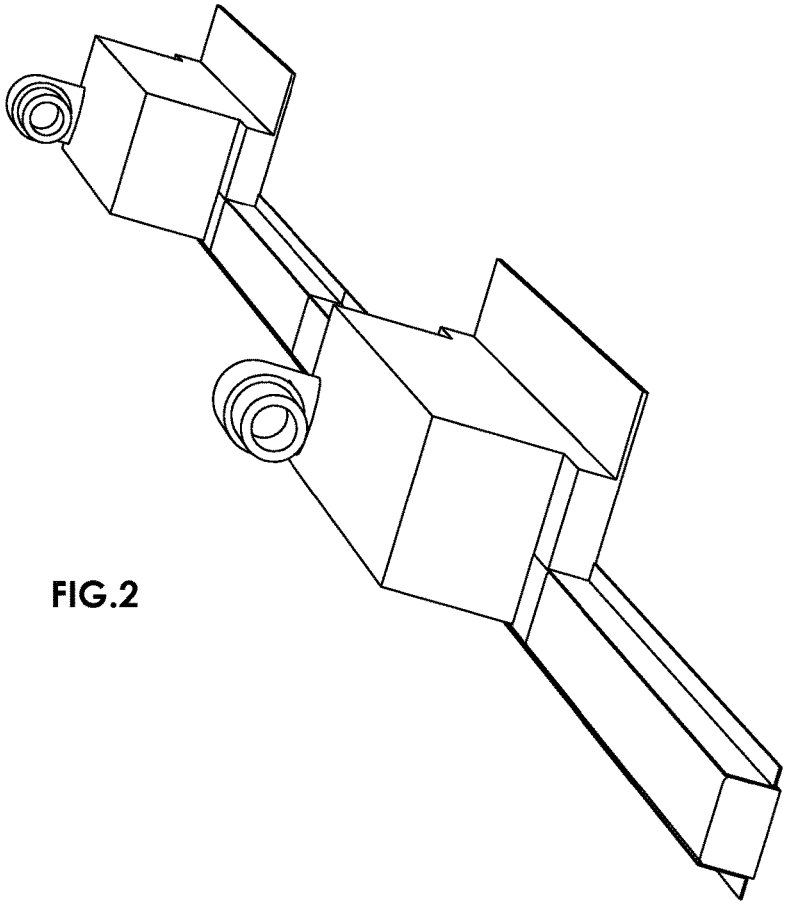
FIG. 2 illustrates an isometric view, rear perspective, of a line segment of the embodied lighting system, in accordance with an exemplary embodiment of the present invention.
Figure 3:
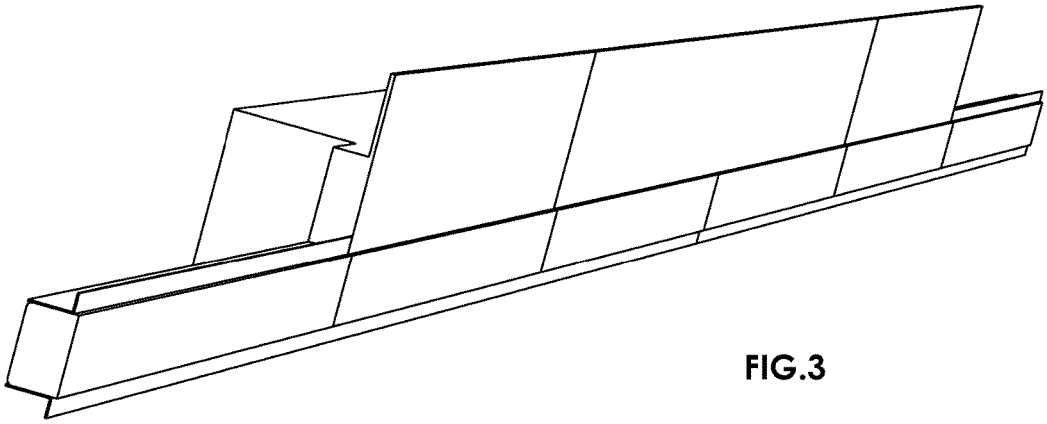
FIG. 3 illustrates an isometric view, frontal perspective, of another line segment of the embodied lighting system, in accordance with an exemplary embodiment of the present invention.
Figure 4:
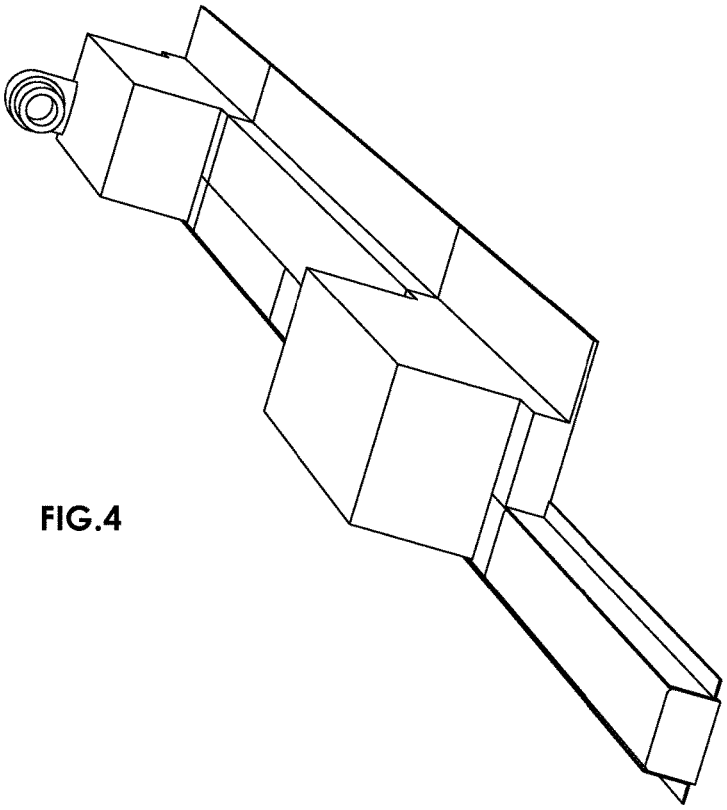
FIG. 4 illustrates an isometric view, rear perspective, of another line segment of the embodied lighting system, in accordance with an exemplary embodiment of the present invention.
Figure 5:
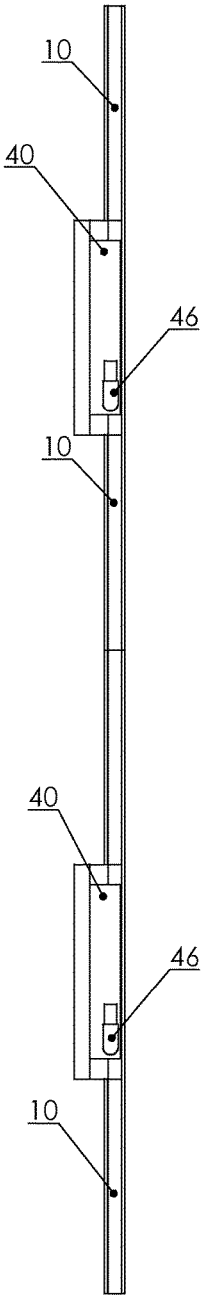
FIG. 5 illustrates a back view of a row of the concatenated run of elongated fixtures having flexible conduit feeding each driver enclosure in that row, in accordance with an exemplary embodiment of the present invention.
Figure 6:
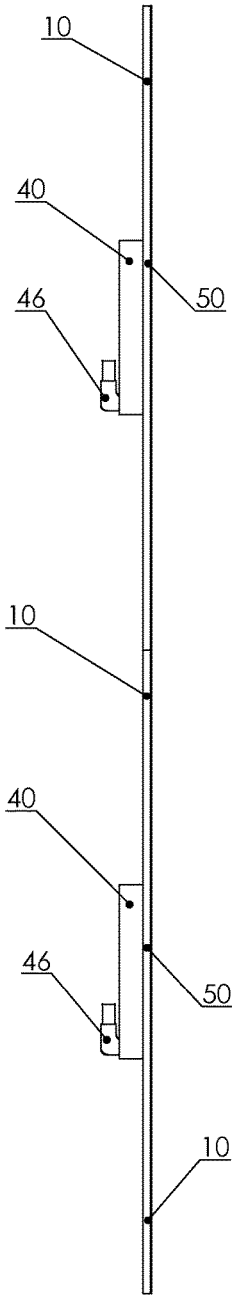
FIG. 6 illustrates a top view of a row of the concatenated run of elongated fixtures having flexible conduit feeding each driver enclosure in that row, in accordance with an exemplary embodiment of the present invention.
Figure 7:
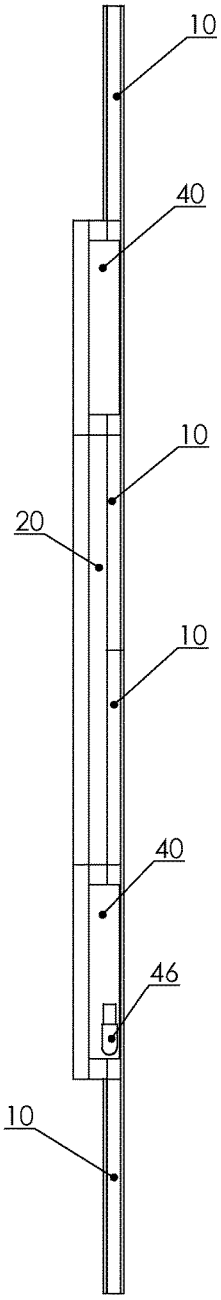
FIG. 7 illustrates a back view of a row of the concatenated run of elongated fixtures having power supply fed to one selected driver enclosure in that row and attached wire chase extrusions 20 to deliver the power from the selected driver enclosure to the remaining driver enclosures, in accordance with an exemplary embodiment of the present invention.
Figure 8:
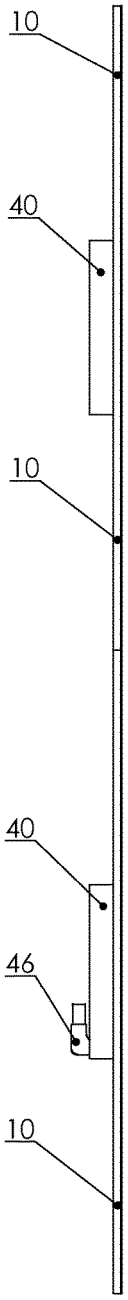
FIG. 8 illustrates a top view of a row of the concatenated run of elongated fixtures having power supply fed to one selected driver enclosure in that row and attached wire chase extrusions to deliver the power from the selected driver enclosure to the remaining driver enclosures, in accordance with an exemplary embodiment of the present invention.
Figure 9:
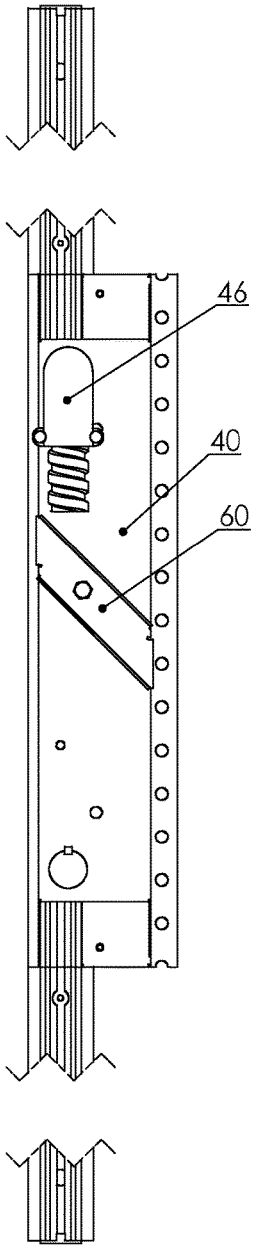
FIG. 9 illustrates a back view of a line segment of the concatenated run of elongated fixtures, in accordance with an exemplary embodiment of the present invention.
Figure 10:
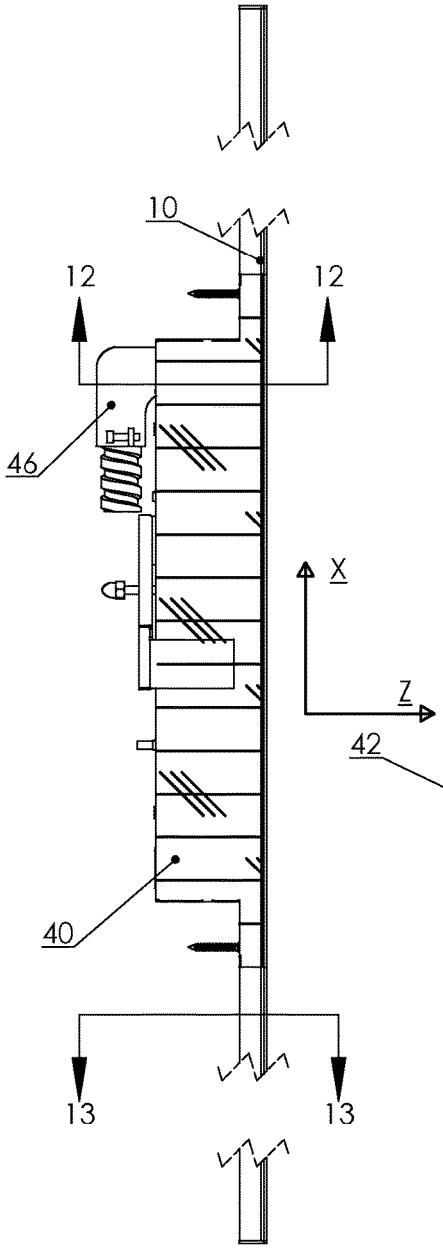
FIG. 10 illustrates a top view of a line segment of the concatenated run of elongated fixtures, in accordance with an exemplary embodiment of the present invention.
Figure 11:
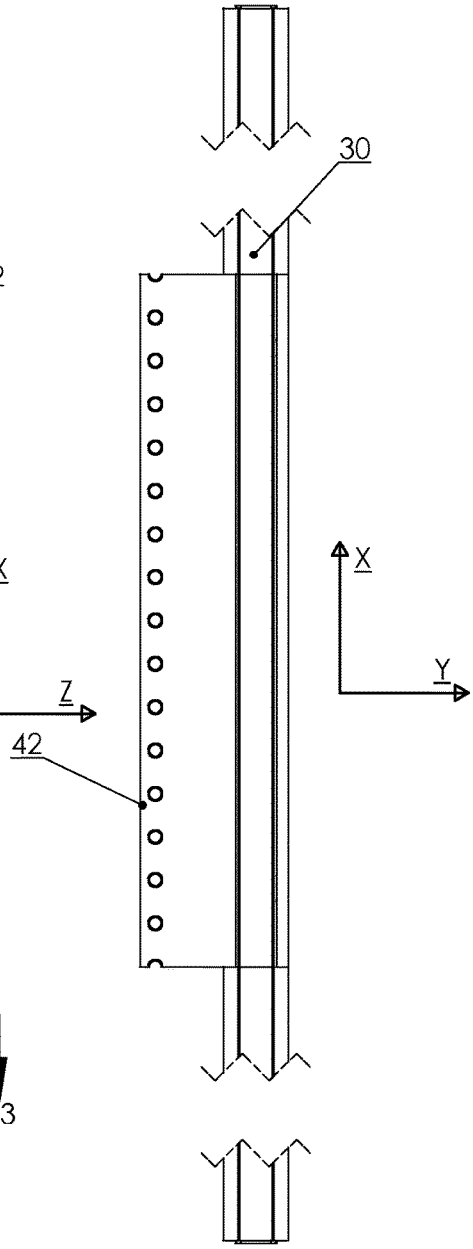
FIG. 11 illustrates a front view of a line segment of the concatenated run of elongated fixtures, in accordance with an exemplary embodiment of the present invention.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF INVENTION

The present invention is focused on methods to configure elongated lighting in different interior building spaces. Although the description of exemplary embodiments is provided below in conjunction with interior building structures, alternate embodiments of the invention are applicable to other illuminated open spaces including, but no limited to, transit, tunnels, staircase, sidewalk, landscape, bollards, parking and other outdoor areas. Furthermore, although the invention has been described with reference to specific methods to configure elongated lighting fixtures embedded into interior and exterior architectural surfaces, these descriptions are not meant to be construed in a limiting sense to these applications but a disclosure to apply these concepts to other related applications as recessed lighting applications, cove, surface mount, suspended or track lighting.

Furthermore, although some embodiments of the invention have been described with reference to specific methods to configure elongated lighting fixtures, it is within the scope of the invention to apply the same concept to any elongated fixture or to a fixture substantially longer than its width. In one embodiment, the invention is an elongated lighting fixture, intended to be installed on a structure without altering the structural members of its framework comprising: an elongated lighting fixture, intended to be installed on a structure without altering the structural members of its framework, comprising: an enclosure, mounted on at least one structural member, wherein said enclosure is sufficiently recessed behind its mounting surface and containing an electrical device used as a power source and control; a channel segment, adjoined said enclosure and mounted on at least one structural member bearing an opening to access said adjoining enclosure; a junction box, adjoined to said channel and located inside said enclosure; a channel housing, abutted to and aligned with said channel segment and mounted on at least one structural member; a wire way chase, mounted on at least one structural member, side by side and in the same direction with said channel; a covering and anchoring surface for said wire way chase; a light source, containing electroluminescent diodes, mounted in said channel, and connected to said electrical device; and, a removable cover, mounted on said channel; wherein said channel would have at least one opening for maintenance access to said power source, after said fixture installation;

In a variation of the embodiment above, the enclosure is placed anywhere along the gap, between the structural members.

In another exemplary embodiment, the invention is an elongated light fixture housing comprising: a channel housing, having one or more complementary located flexible locking features; a removable cover, having one or more complementary located flexible locking features; wherein said complementary located flexible locking features engage functioning as a snap-fit cover attachment system for the elongated light fixture.

In another exemplary embodiment, the invention is an elongated light fixture housing comprising: a channel housing, comprising an outer surface and an inner surface, having at least one indentation integrally formed on its inner surface, in at least one of its side walls; and a removable cover, comprising an outer surface and an inner surface, having at least one complementary indentation integrally formed on its outer surface; wherein said indentation of said channel is for receiving and retaining said complementary indentation of said removable cover and functioning as a snap-fit attachment system of said cover to said channel.

The term "L.E.D." is known in the art and relates to Light-Emitting Diode: a semiconductor diode that emits light when an electric current passes thru it as a result of a specific voltage applied to its terminals.

The term "L.E.D. driver" is known in the art and relates to an electrical device that manages power and controls the current flow to an L.E.D. lighting source. The electrical device is connected to a power source.

The term "driver enclosure" (abbreviated as D.E.3) is related to the L.E.D. driver enclosure, component 40 in our description, and is known in the art as the electrical enclosure housing the L.E.D. driver and constituting a part of the luminaire intended to:

(a) reduce the risk of contact with live parts;

(b) enclose electrical parts and components that can involve a risk of fire;

(c) protect internal parts from mechanical damage; and (d) protect internal parts from the environment.

The term "internal junction box" is an enclosure functioning as a compartment to separate the low voltage wiring circuit from the high voltage branch wiring circuit. The branch wiring compartment must be enclosed in a space with a minimum volume of 6 cubic inches, per U.L. standard 1598.

The term "opening" should be construed per Underwriters Laboratories (U.L.) definition as "an aperture in an enclosure that is covered or filled by a plug or knockout and that has the potential of becoming an open hole".

The term "knockout" (abbreviated as K.O.) relates to a partially cut-out opening that is closed until the precut material is removed. A similar explanation should be related to the term "half-shear" that will be used in our detailed description of the invention embodiment.

The term "heat sink" should be construed as a material of a particular shape intended to absorb excessive heat from a surface and dissipate that heat thru other surfaces.

The term "countersink" should be construed as a conical hole cut into a manufactured object.

The term "plaster" should be construed as "a mixture of lime or gypsum, sand, and water, sometimes with fiber added, that hardens to a smooth solid" and is used for coating walls and ceilings.

The term "spackle" is a trademark referencing a compound used to fill cracks in plaster and produce a smooth surface.

The term "spackle flange" is known in the art as that lighting fixture component that is placed in contact with architectural surfaces for the purpose of applying spackle on top of it and bonding the fixture housing to the architectural surface. Alternatively, in another embodiment, the term "covering and anchoring surface" is largely used in reference to the "spackle flange" component but it's not intended to be limited to that particular embodiment.

The term "elbow fitting" is used in piping and electrical fittings to define a change of direction of an electrical conduit at a specific angle (usually 90 degrees).

The term "hinge joint" is used in some embodiments of this invention to define an articulation that would allow motion only in one plane.

For the purpose of this invention, the term "structure" is used in reference to the framework of a building such as an edifice for commercial, residential and industrial space or any other construction establishment.

The term "stud" is known as a building material that is used to construct the frame of that structure.

The term "recessed" is used, in this invention, to define a setback position of a component relative to a planar surface or a mounting surface.

The term "channel" is used to reference an element having an elongated base, a first and a second wall, first wall disposed at a certain distance from the second wall, and extending from the base in a common direction therefore forming a cavity with two open ends.

The abbreviation "H.V.W.C.3" meaning "High Voltage Wire Channel" is in reference to component 20 of the lighting fixture segment. Alternatively, in another embodiment, the features of component 10 are combined with the features of component 20 to form on piece construction and this new component would be named "channel with integral wire way chase".

The abbreviation "R.Ph." meaning 'Remote Phosphor' is in reference to the phosphor material that is not part of a packaged L.E.D. but is part of the optical elements labeled 30 and 31, known in the lighting industry as being used in correlation with 'blue' L.E.D. emitters.

The abbreviation "P.I.S./H.-L.E." meaning "Power Input Segment/Housing for Light Engine" is in reference to component 50 of the lighting fixture segment; Alternatively, in another embodiment, the term "channel segment" is used in reference to component 50, within the scope of the invention, but not limited to that particular embodiment. The abbreviation "T-slot" represents a groove cut into a material, like aluminum, with a tool having the shape of letter 'T', like an extrusion tool.

In an exemplary embodiment, a fastening method is employed to secure at least two components by interlocking their own features (fastening by shape) or by using intermediate fasteners like screws, clips, clasps, glue, etc.

A "snap-fit" is a mechanical joint system where part-to-part attachment is accomplished with locating and locking features (constraint features) that are homogenous with one or the other of the components being joined. Joining requires the (flexible) locking features to move aside for engagement with the mating part, followed by return of the locking feature toward its original position to accomplish the interference required to latch the components together. "-*The First Snap-Fit Handbook*", Bonenberger, 2000 is incorporated herein by reference. Some examples of locking features are: hooks, ridges, grooves, buttons, holes, depressions, indentations, etc.

Descriptions of snap-fit joints can be found in US patent application no. US20070000922 A1 and U.S. Pat. No. 5,102,253 A incorporated herein by reference. Snap-fits joints advantageously eliminate other joining methods, e.g. screws, clips, and adhesives.

For the purpose of this invention, the term "groove" is a long, narrow cut or depression, especially one made to guide motion or receive a corresponding ridge.

For the purpose of this invention, the term "rib" is a long raised piece of stronger or thicker material across a surface or through a structure.

The term "co-extruded" is used when more than one plastic material is pressed, in the same time, thru the same die, to produce a single piece part;

For the purpose of defining directionality, a coordinate system needs to be related to an elongated segment of the lighting system having a light emitting surface normal to Z axis of a cartezian coordinate system while its length is defined in the X direction and its width in Y direction.

Figure 14:
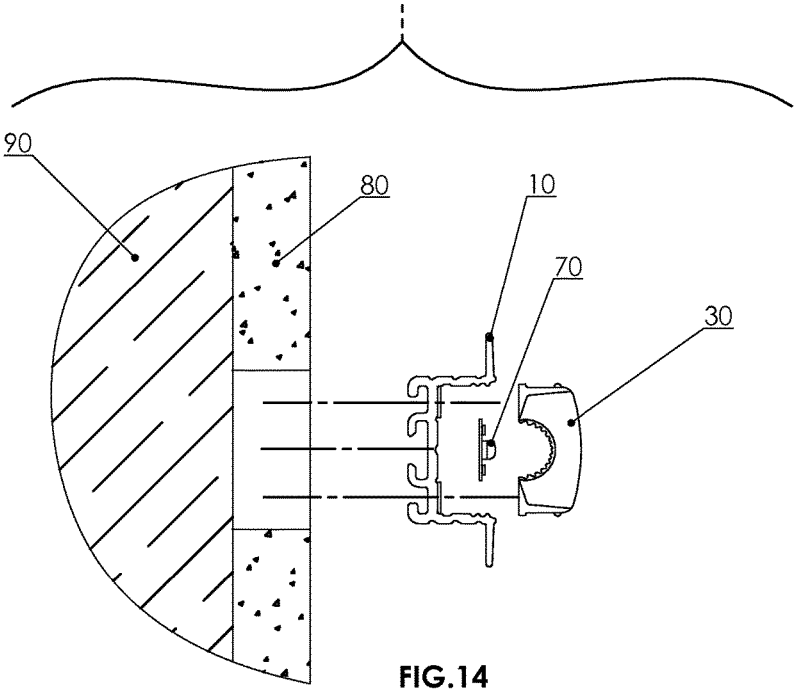
FIG. 14 illustrates an exploded view of a line segment of the concatenated run of elongated fixtures to be installed in a planar surface, in accordance with an exemplary embodiment of the present invention.

In an exemplary embodiment, depicted in FIG. 14-A, a planar surface could be a wall 80 that is constructed from one or more drywall sheets arranged on a conventional stud frame. A gap of predefined shape could be created by removing a portion or portions from the one or more drywall sheets. Alternatively, the lighting fixture may first be installed on the studs 90 and the wall may be added later. In other embodiments, the wall may be constructed of wallboard, lathing for plaster, wood, or any other material used to construct an architectural surface.

Figure 15:
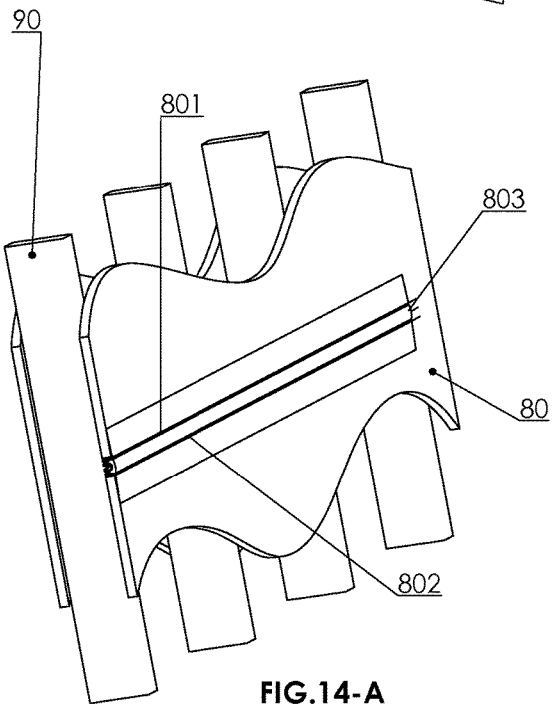
FIG. 15 illustrates a side view of a line segment of the concatenated run of elongated fixtures installed in a planar surface, in accordance with an exemplary embodiment of the present invention.
Figure 15:
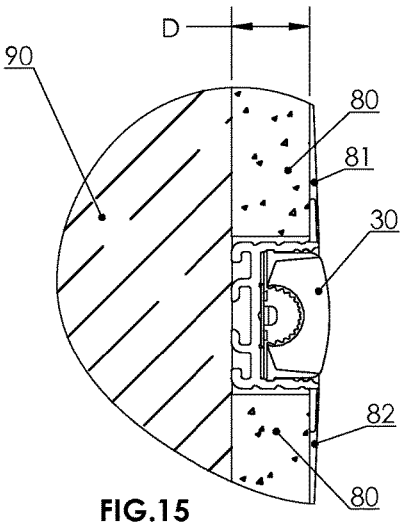
Figure 16:
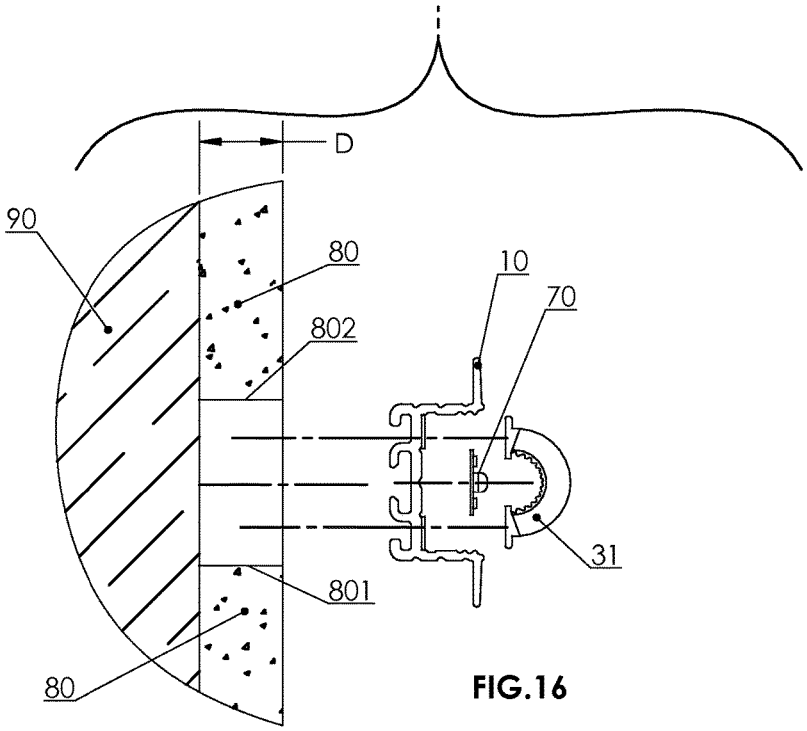
FIG. 16 illustrates another exploded view of a line segment of the concatenated run of elongated fixtures to be installed in a planar surface, in accordance with an exemplary embodiment of the present invention.
Figure 17:
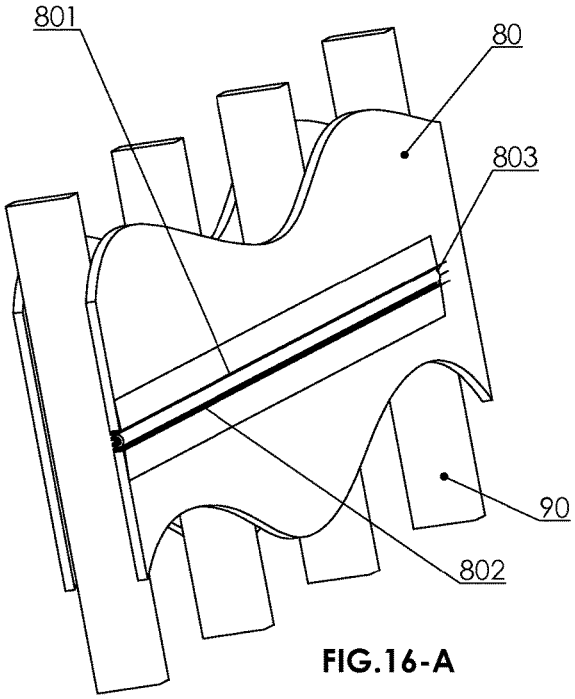
FIG. 17 illustrates a side view of a line segment of the concatenated run of elongated fixtures installed in a planar surface, in accordance with an exemplary embodiment of the present invention.
Figure 17:
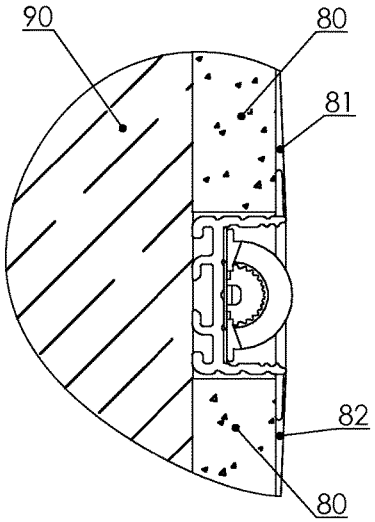

As illustrated by FIG. 14-A, the basic shape of the gap for an elongated segment fixture could have two parallel edges 801 and 802 and it might have an end similar to edge 803. The main components of the slim form factor fixture segment are comprised of: aluminum extruded light engine housing 10, light diffusing/converting optical element 30 and L.E.D. light engine 70, as depicted by FIG. 14. A side view of the main components is illustrated by FIG. 15 while FIG. 14 is intended to clarify the profile of these components in an exploded view. A similar scenario is depicted by FIG. 16, except the lens 31 are different. A side view of the main components is illustrated by FIG. 17 while FIG. 16 is intended to clarify the profile of these components in an exploded view.

Figure 18:
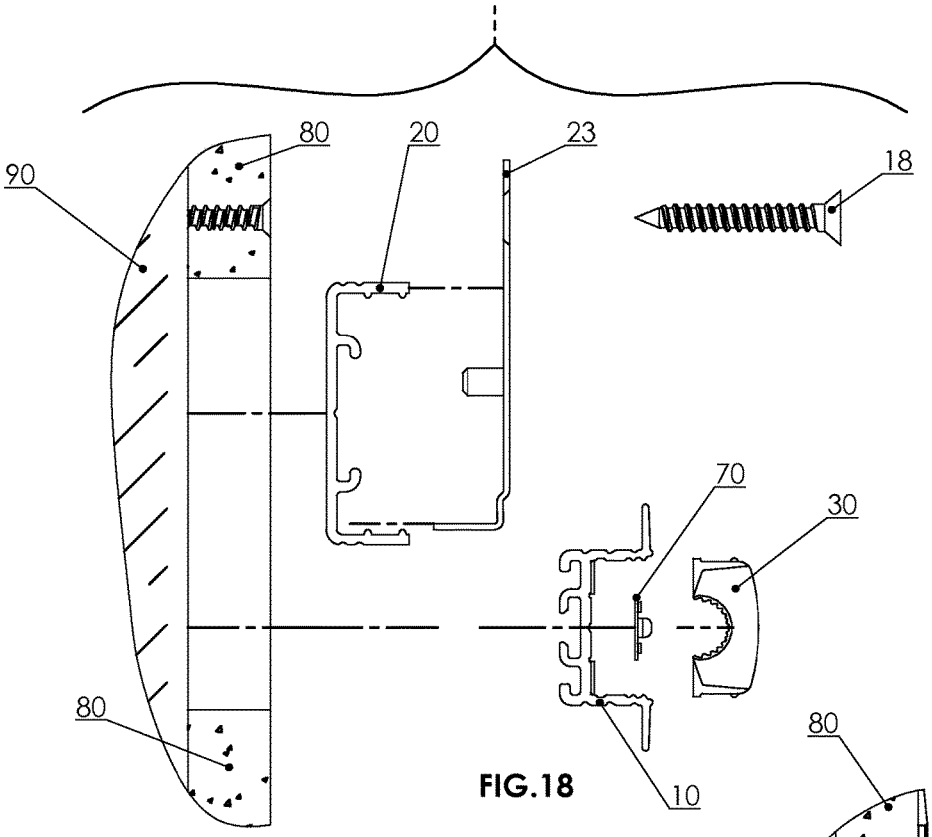
FIG. 18 illustrates an exploded view of a line segment of the concatenated run of elongated fixtures to be installed in a planar surface along with additional high voltage wireway, in accordance with an exemplary embodiment of the present invention.
Figure 19:
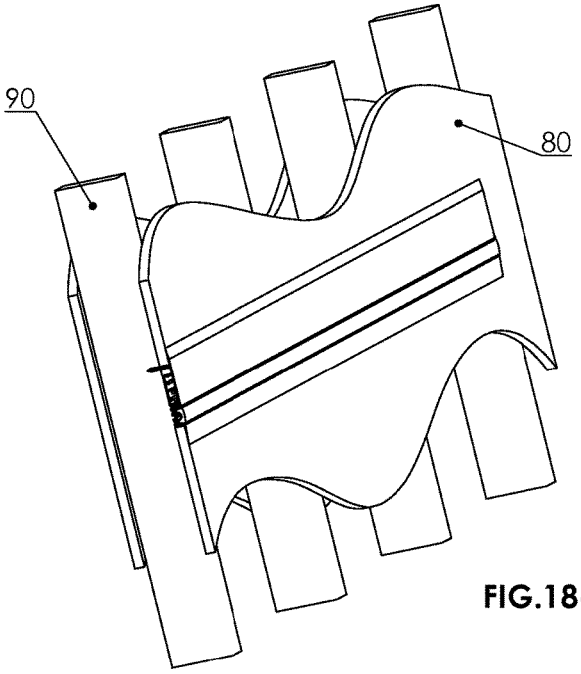
FIG. 19 illustrates a side view of another line segment of the concatenated run of elongated fixtures installed in a planar surface along with additional high voltage wireway, in accordance with an exemplary embodiment of the present invention.
Figure 19:
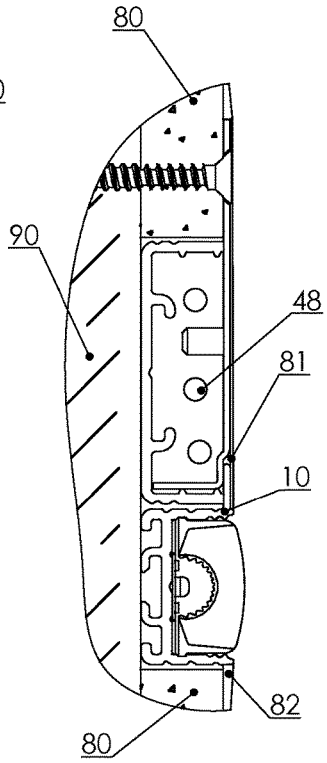
Figure 20:
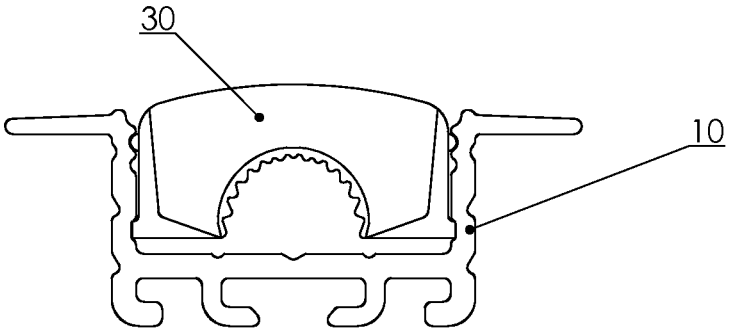
FIG. 20 illustrates a side view of light engine housing, component 10, assembled with the co-extruded lens, component 30, in accordance with an exemplary embodiment of the present invention.
Figure 21:
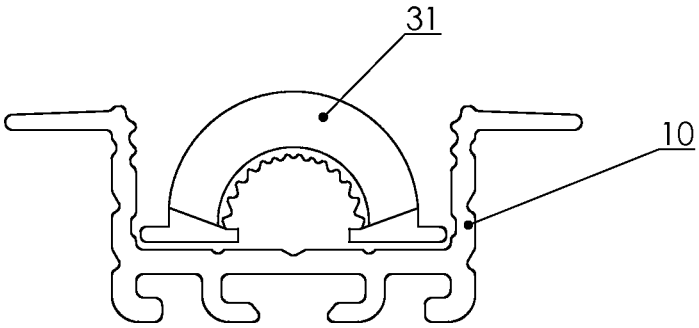
FIG. 21 illustrates a side view of light engine housing, component 10, assembled with other co-extruded lens, component 31, in accordance with an exemplary embodiment of the present invention.

When a high voltage wire way channel H.V.W.C.3 is needed between the L.E.D. driver compartments, a "spackle flange" version could be installed, as illustrated by FIG. 18. The main components of the 'spackle flange' fixture segment are comprised of: separate extruded high voltage wireway chase mounted on one side of the LED strips housing, component 20, spackle flange 23 installed to the planar surface with the screws 18, aluminum extruded light engine housing 10, light diffusing/converting optical element 30, and L.E.D. light engine 70. A side view of the main components is illustrated by FIG. 19 with the wire 48 installed inside the H.V.W.C.3, while FIG. 18 is intended to clarify the profile of these components, in an exploded view.

Figure 83:
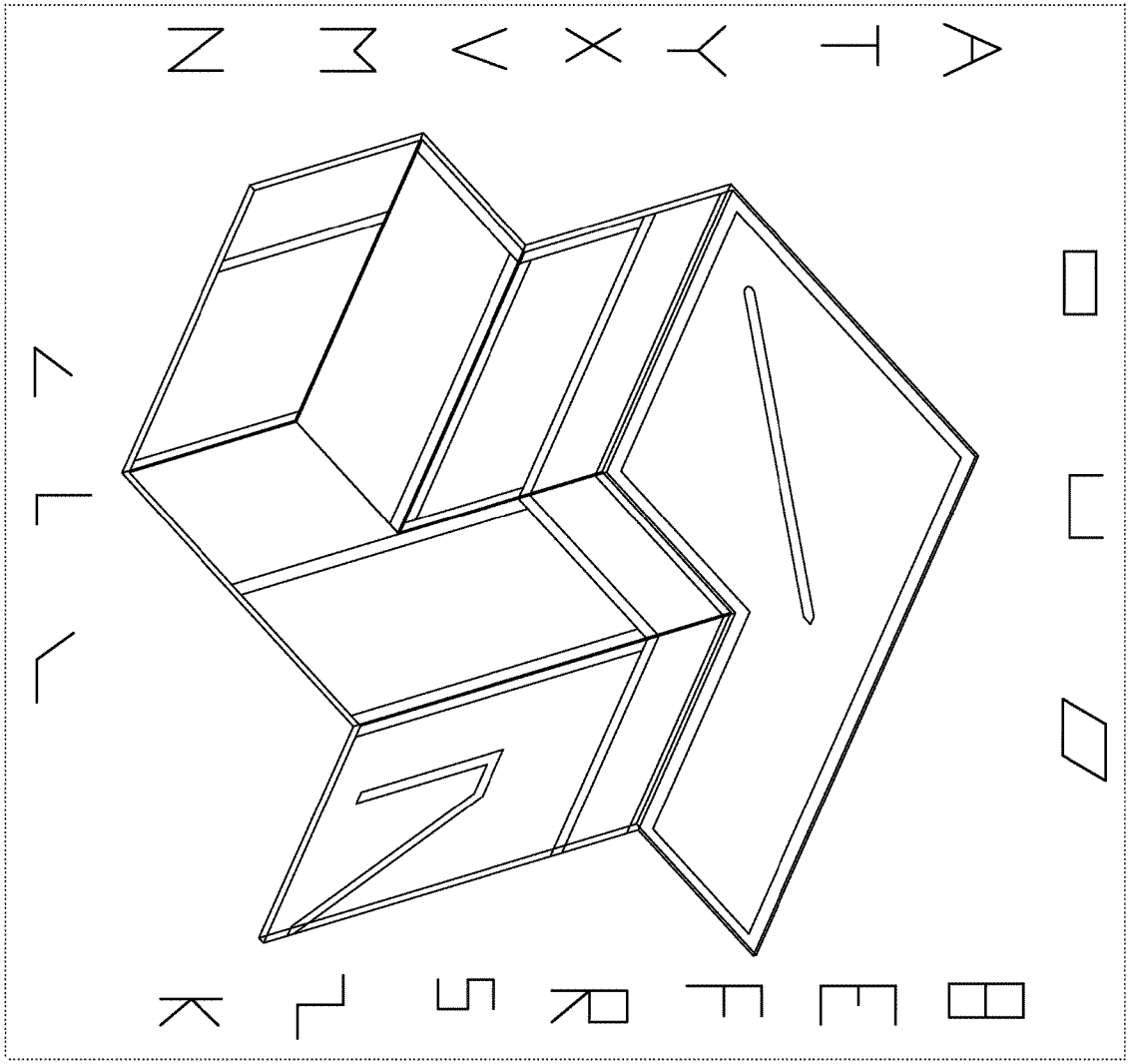
FIG. 83 illustrates a perspective view of some geometrical figures that could be created on three dimensional planar surfaces utilizing the lighting system in accordance with an exemplary embodiment of the present invention.
Figure 84:
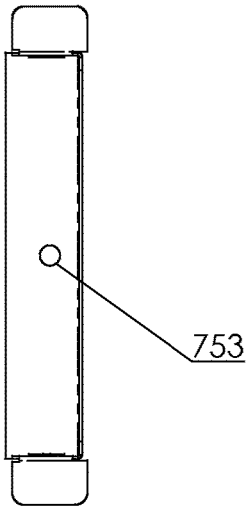
FIG. 84 illustrates a top view of component 75, named "internal junction box", in accordance with an exemplary embodiment of the present invention.
Figure 85:
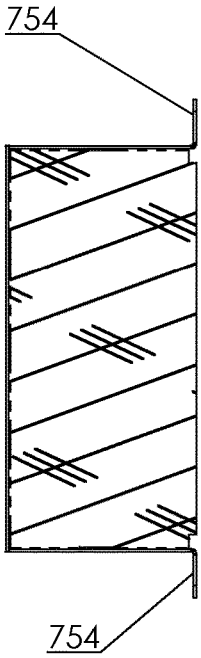
FIG. 85 illustrates a front view of component 75, named "internal junction box", in accordance with an exemplary embodiment of the present invention.
Figure 86:
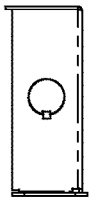
FIG. 86 illustrates a side view of component 75, named "internal junction box", in accordance with an exemplary embodiment of the present invention.

In an exemplary embodiment, a gap of predefined shape might be formed in the planar surface similar to a concatenated sequence of "open" line segments with different angles between them. As seen in FIG. 83, shapes resembling alphabet letters (A,U,C,H,K,L,M,N,T,V,X,Y,Z) could be created on existent architectural surfaces as well as many other geometric figures.

Figure 28:
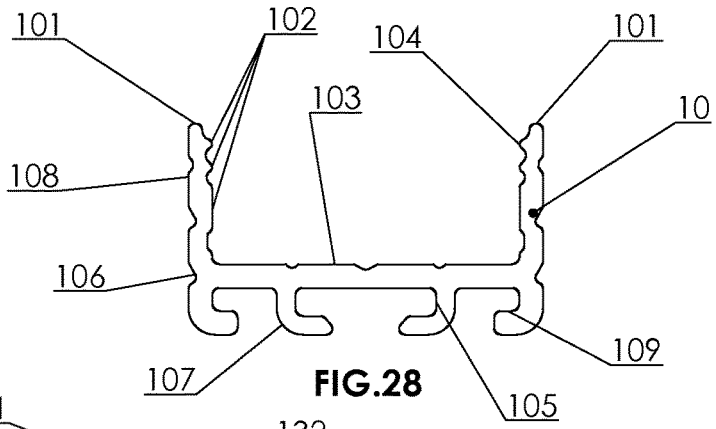
FIG. 28 illustrates a side view of a light engine housing, component 10, in accordance with an exemplary embodiment of the present invention.

In an exemplary embodiment, as depicted in FIG. 28, an important component of the fixture is the aluminum extruded light engine housing 10 or its variations, components 13 or 14, depicted in FIG. 28-A and FIG. 28-B. The component 20, depicted in FIG. 29, it was intended as H.V.W.C.3 but could be used as a light engine housing. This component and its variations, could be an aluminum extrusion that may or may not be painted depending on certain circumstances. Other preferred materials to manufacture this part are the heat conductive materials and/or materials with electrical insulator properties. Some of its features, as referenced in FIG. 28 or FIG. 28-A: 101 (and its variations 131, 141) are 'walls' intended to be a protective barrier to block particles, like those of the spakle compound 81, 82 or those of the planar surface 80 illustrated in FIG. 15, from reaching the lens 30 or the light source 70.

Figure 29:
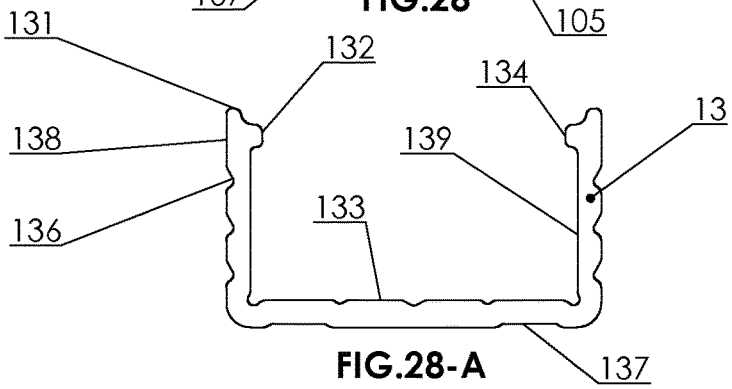
FIG. 29 illustrates a side view of a high voltage wire way chase, component 20, in accordance with an exemplary embodiment of the present invention.
Figure 29:
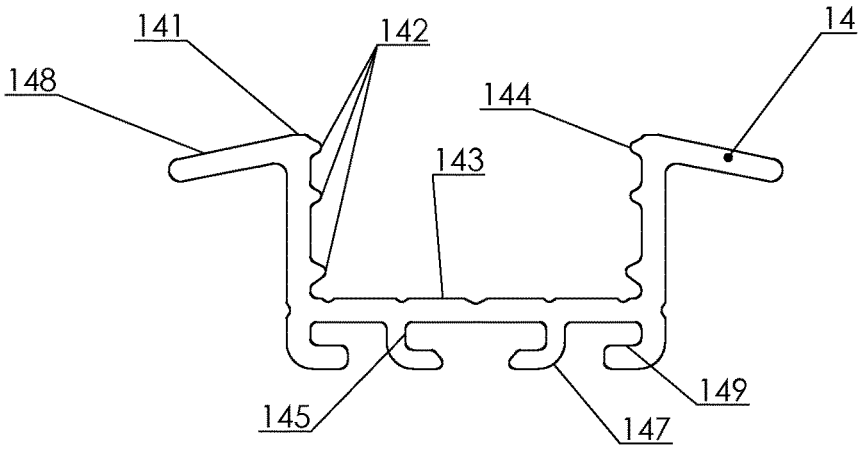
Figure 29:
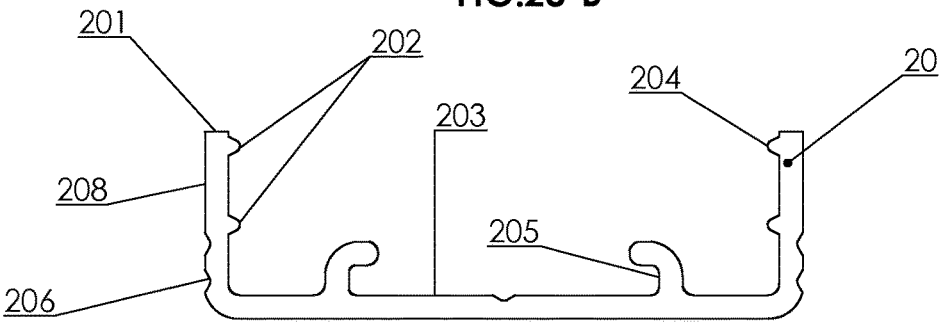

The surfaces 108, 138, 148 or 208 might be an exposed or visible surface, in some configurations, therefore serving as a decorative surface with a required finish. The protrusions 102 and 104 (respectively 132 and 134, or 142 and 144 or 202 and 204) could be one or multiple pairs intended to retain the lens 30 or other lens variations 31, 36, 37 and 38, while they are inserted into the channel housing. They are also designed to allow the removal of the lens while a thin object is inserted, between the lens and the housing, and acceptable force is applied on that object. The surface 103 (or 133, 139, 143, 203) is a mounting surface for the L.E.D. light source 70. The top surfaces 101, 131 or 141 are visible from the room side therefore their alignment is important as they have to be perceived as continuous line independent of the number of fixtures that are in the row. The features 105, 145 or 205 could be described as a 'T' slot. This is intended as a receiver slot for corner cleats or alignment plates as those depicted in FIG. 36 thru FIG. 40. The same slots could be used as screw chase feature designed to receive self tapping screws installed from the end. Those screws are used to secure the end caps of the continuous run. The surface 103, 123, 143 or 203 is also the surface where the installer would drill holes to secure the fixtures to the structure with wood screws or could have pre-drilled holes to align and pull the extrusions 10 together with the help of self tapping flat head screws and by using aligner plates 25 or corner cleats 26 thru 29. The aligners 25 thru 29, being made of thick steel, could be a guide to drill the holes in the aluminum extrusion especially when the extrusion was "field cut to length" and the holes were removed with the scrap piece. The grooves 106, 136 or 206 of FIG. 28 thru FIG. 29 are intended for mounting these extrusions, to the structure, with the help of a few clips, component 15, as exemplified in FIG. 61. The ribs on the bottom 107, 137 or 147 are intended to increase the heat transfer surface on the opposite side of surface 103, where the light engine is installed, and could be considered as heat sink fins. The tabs 109 and 149 are intended to support the access doors while they are shut and to stop them from swinging inside the electrical enclosure 40.

Figure 13:
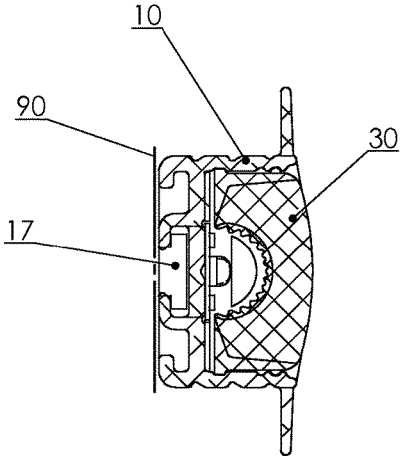
FIG. 13 illustrates section view of a line segment of the concatenated run of elongated fixtures taken along section line 13-13 as labeled in FIG. 10, in accordance with an exemplary embodiment of the present invention.
Figure 30:
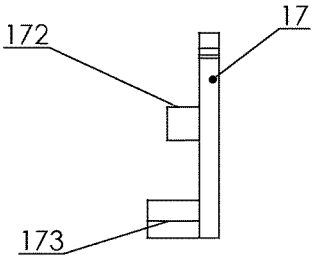
FIG. 30 illustrates a side view of an end cap, component 17, in accordance with an exemplary embodiment of the present invention.
Figure 31:
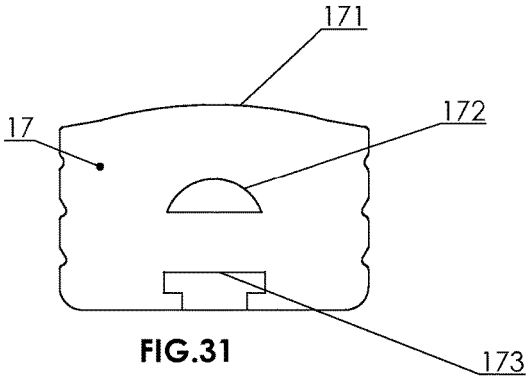
FIG. 31 illustrates a front view of an end cap, component 17, in accordance with an exemplary embodiment of the present invention.
Figure 32:
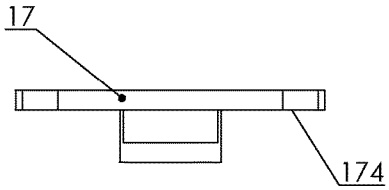
FIG. 32 illustrates a top view of an end cap, component 17, in accordance with an exemplary embodiment of the present invention.
Figure 33:
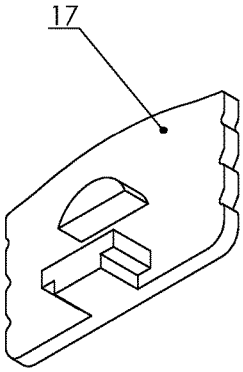
FIG. 33 illustrates an isometric view of an end cap, component 17, in accordance with an exemplary embodiment of the present invention.
Figure 78:
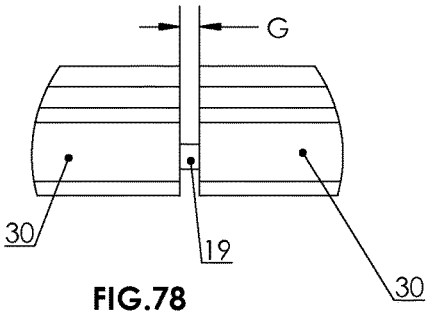
FIG. 78 illustrates a side view of a method to join consecutive optical elements 30 with a joiner piece 19, in accordance with an exemplary embodiment of the present invention.
Figure 79:
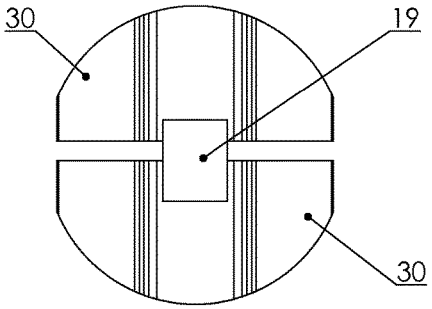
FIG. 79 illustrates a bottom view of a method to join consecutive optical elements 30 with a joiner piece 19, in accordance with an exemplary embodiment of the present invention.
Figure 80:
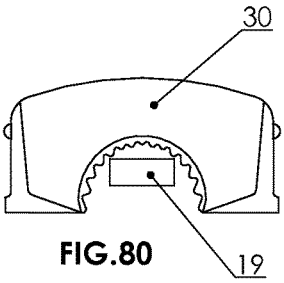
FIG. 80 illustrates a front view of another method to join consecutive optical elements 30 with a joiner piece 19, in accordance with an exemplary embodiment of the present invention.
Figure 81:
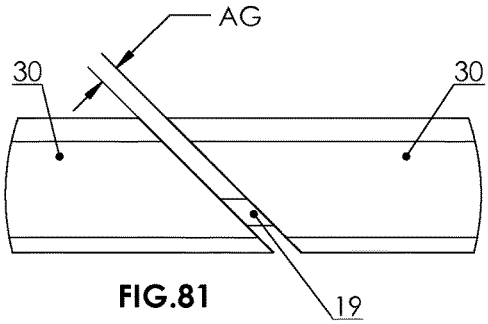
FIG. 81 illustrates a side view of another method to join consecutive optical elements 30 with a joiner piece 19, in accordance with an exemplary embodiment of the present invention.
Figure 82:
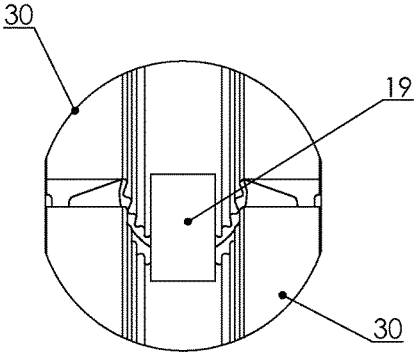
FIG. 82 illustrates a bottom view of another method to join consecutive optical elements 30 with a joiner piece 19, in accordance with an exemplary embodiment of the present invention.

At the ends of the continuous row or on a standalone fixture we would install end caps. One exemplary embodiment, depicted in FIG. 33 is component 17. This could be made out of injection molded plastic materials, metal casting or other manufacturing methods well known in the industry. The end cap could be opaque, translucent or transparent. The feature 173 would match the 'T-slot' of the light engine housing and would guide and locate the end cap relative to the light engine. If the end cap is opaque, it is recommended that the surface 174 is highly reflective, especially with blue pump L.E.D. sources. The top edge 171 is intended to match the outside profile of light diffusing/converting optical elements to avoid visible discontinuity in a row of fixtures. For blue pump L.E.D. sources, especially on those fixtures with exposed end caps, these could be manufactured by using the remote phosphor material. In a blue pump system, an important role of an end cap is to mitigate the blue light 'leakage' by minimizing the gaps at the end. The end cap could have a protrusion 172, as illustrated in FIG. 30 and FIG. 31. This would overlap inside the vaulted surface of component 30 or 31 and above the L.E.D. source, as depicted in FIG. 13. Another role of the end cap is to mitigate the gaps created due to the thermal expansion/contraction of different materials. The thermal expansion/contraction needs to be taken into consideration between multiple segments of a row. A few solutions are presented in FIG. 77 thru FIG. 82. Two successive light diffusing/converting optical elements 30 could be straight cut, with a gap 'G' as illustrated in FIG. 78, or could be cut at an angle, with a gap 'AG' as depicted in FIG. 81. An internal element 19, of a similar material composition, pre-attached to one of the optical elements would be a viable option to ensure continuity of the light line.

Another component of some lighting fixtures, especially those configurations with more than one D.E.3 in a row, is the high voltage wire way chase, item 20, as illustrated in FIG. 29. This component could be made out of extruded aluminum. FIG. 19 illustrates the space where the high voltage wire 48 will be located inside the H.V.W.C3. Feature 205 is a T-slot feature intended for alignment plates or corner cleats.

Figure 34:
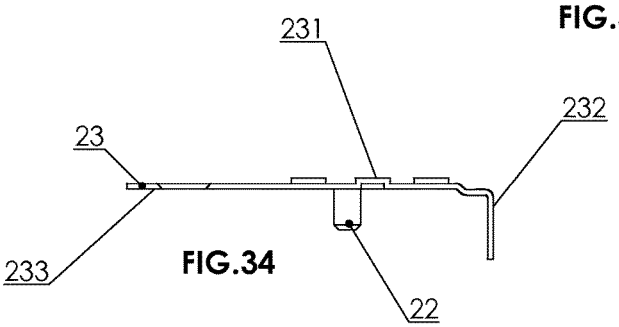
FIG. 34 illustrates a side view of the spackle flange, component 23, in accordance with an exemplary embodiment of the present invention.
Figure 35:
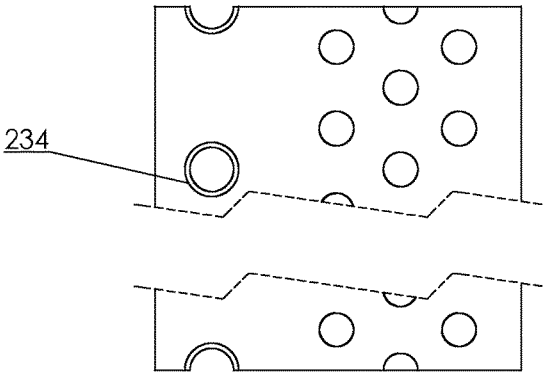
FIG. 35 illustrates a top view of the spackle flange, component 23, in accordance with an exemplary embodiment of the present invention.
Figure 36:
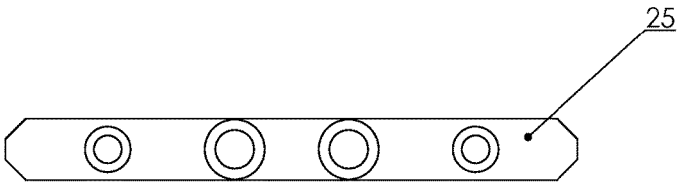
FIG. 36 illustrates a top view of the alignment plate 25, in accordance with an exemplary embodiment of the present invention.
Figure 37:
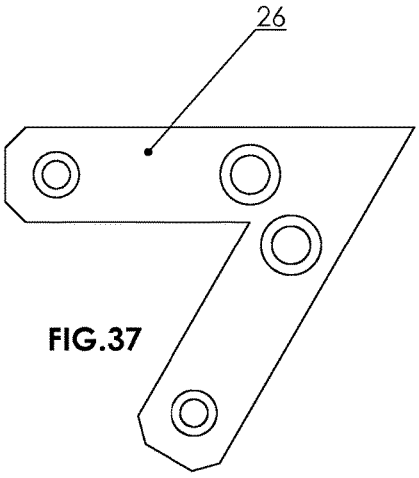
FIG. 37 illustrates a top view of an acute corner cleat 26, in accordance with an exemplary embodiment of the present invention.
Figure 38:
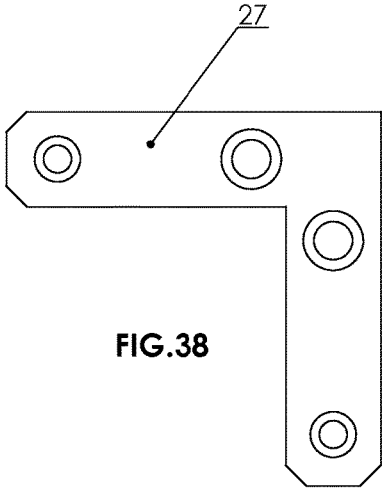
FIG. 38 illustrates a top view a normal corner cleat 27, in accordance with an exemplary embodiment of the present invention.
Figure 39:
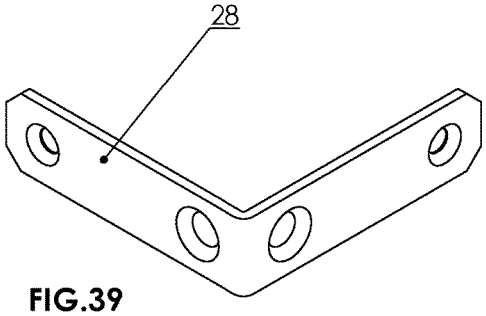
FIG. 39 illustrates a perspective view of a bent corner cleat 28, in accordance with an exemplary embodiment of the present invention.
Figure 40:
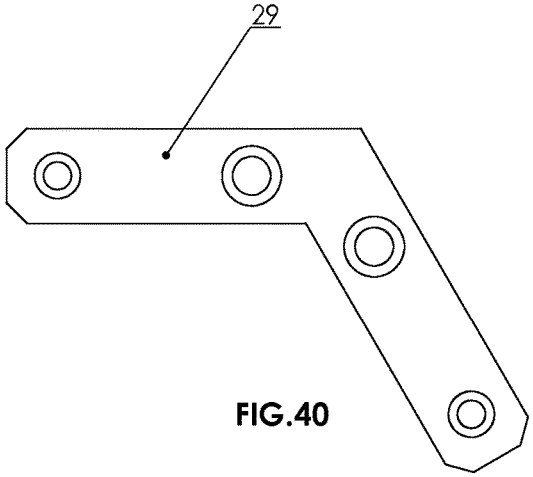
FIG. 40 illustrates a top view an obtuse corner cleat 29, in accordance with an exemplary embodiment of the present invention.
Figure 41:
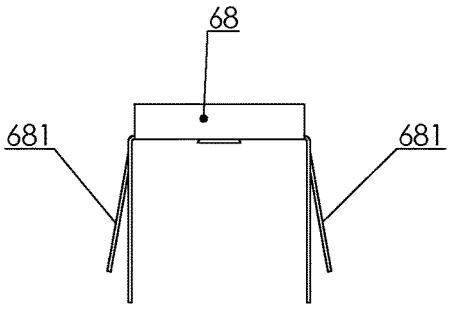
FIG. 41 illustrates a front view of the slip thru bracket, component 68, in accordance with an exemplary embodiment of the present invention.
Figure 42:
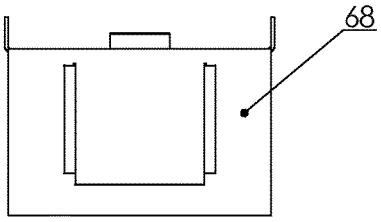
FIG. 42 illustrates a side view of the slip thru bracket, component 68, in accordance with an exemplary embodiment of the present invention.
Figure 43:
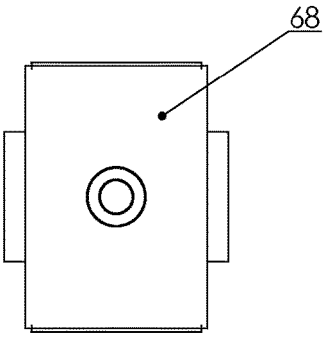
FIG. 43 illustrates a top view of the slip thru bracket, component 68, in accordance with an exemplary embodiment of the present invention.
Figure 44:
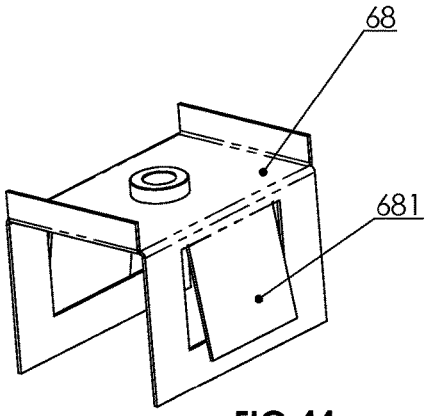
FIG. 44 illustrates a perspective view of the slip thru bracket, component 68, in accordance with an exemplary embodiment of the present invention.
Figure 45:
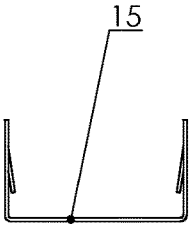
FIG. 45 illustrates a front view of the surface mount bracket, component 15, in accordance with an exemplary embodiment of the present invention.
Figure 46:
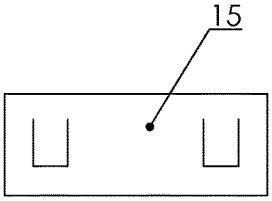
FIG. 46 illustrates a side view of the surface mount bracket, component 15, in accordance with an exemplary embodiment of the present invention.
Figure 47:
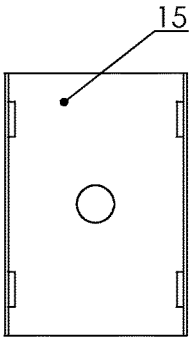
FIG. 47 illustrates a top view of the surface mount bracket, component 15, in accordance with an exemplary embodiment of the present invention.
Figure 48:
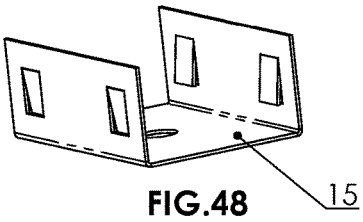
FIG. 48 illustrates a perspective view of the surface mount bracket, component 15, in accordance with an exemplary embodiment of the present invention.
Figure 49:
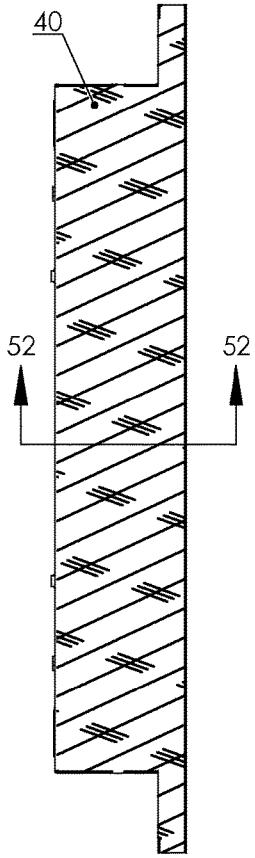
FIG. 49 illustrates a top view of component 40, named 'L.E.D. driver enclosure', in accordance with an exemplary embodiment of the present invention.
Figure 50:
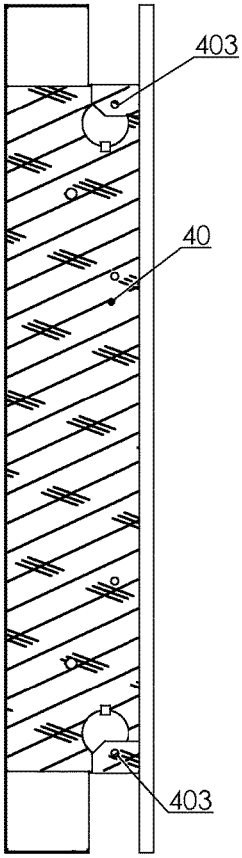
FIG. 50 illustrates a front view of component 40, named 'L.E.D. driver enclosure', in accordance with an exemplary embodiment of the present invention.

Another component of the lighting fixtures, exemplified in FIG. 34 and FIG. 35, is the spackle flange 23, preferably made of sheet metal (aluminum, or steel or polymer) but could also be an extruded aluminum component with secondary operations. Grounding screw 22 needs to be factory installed. This could be pre-installed with grounding wire, eyelet, nut and star washer (not shown). The dimples 231 are so called "half-shear" features, well known in sheet metal industry and described previously. They are intended to create the rough surface needed to retain the spackle compound on top of the spackle flange 23. Alternatively, other protruding features could be formed for the above mentioned purpose. The flange 232 has multiple purpose: one is to strengthen the rigidity of a thin sheet metal, when that sheet metal is bent along its surface, and to flatten the remaining surface, the second purpose is to locate the spackle flange relative to the fixture housing. The feature 233 is the surface that is sitting on top of the existent planar surface, like a drywall. The holes 234 are countersink holes intended to reduce the overall height of a flat head screw 18 and allow spackle compound coverage as seen in FIG. 19.

Another component of the lighting fixtures, exemplified in FIG. 54, FIG. 74, FIG. 75 and FIG. 76-A is the access cover 55, preferably made of sheet metal (aluminum or steel) but could also be an extruded aluminum component with secondary operations. Similar materials could be used for component 59 power access cover, exemplified in FIG. 54-A, FIG. 75, FIGS. 75 and 76-A. Grounding screw 56 needs to be factory installed. This could be pre-installed with grounding wire, eyelet, nut and star washer (not shown). Alternatively, the access covers could be installed directly to the driver enclosure D.E.3 with screws, thus ensuring the bonding between these components without the need to install additional grounding screws.

Figure 22:
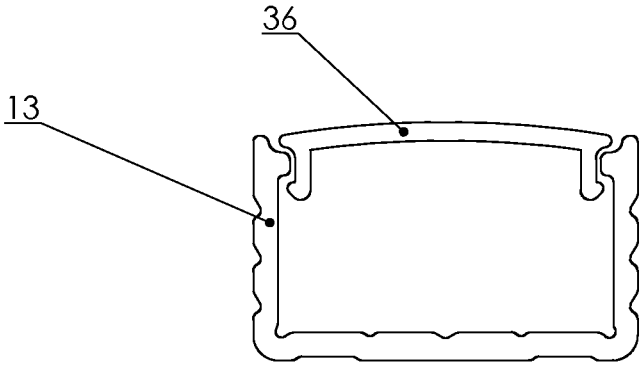
FIG. 22 illustrates a side view of other light engine housing, component 13, assembled with other extruded lens, component 36, in accordance with an exemplary embodiment of the present invention.
Figure 23:
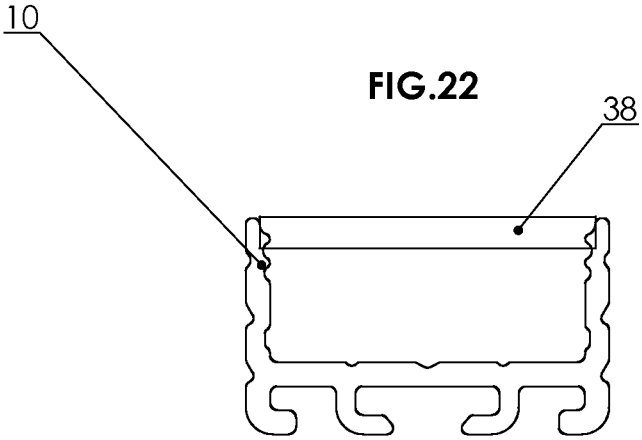
FIG. 23 illustrates a side view of the light engine housing, component 10, assembled with planar lens, component 38, in accordance with an exemplary embodiment of the present invention.
Figure 24:
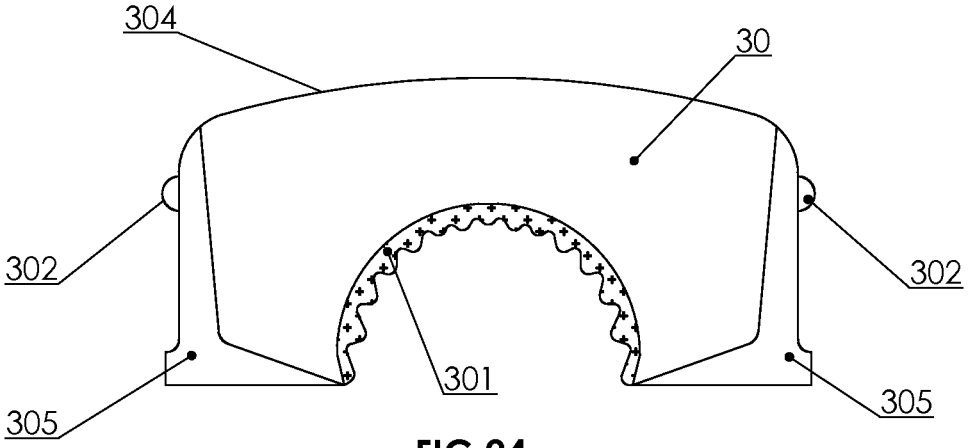
FIG. 24 illustrates a side view of optical element 30, in accordance with an exemplary embodiment of the present invention.
Figure 25:
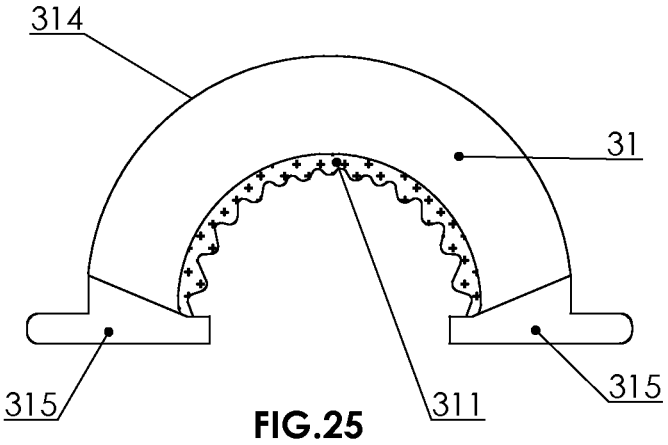
FIG. 25 illustrates a side view of another optical element 31, in accordance with an exemplary embodiment of the present invention.
Figure 26:
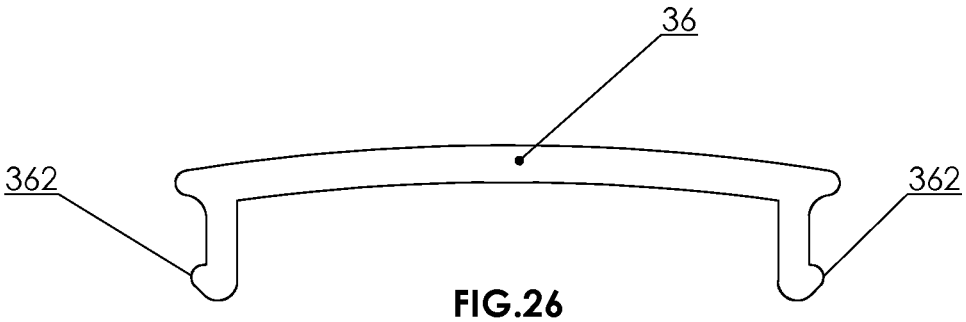
FIG. 26 illustrates a side view of another optical element 36, in accordance with an exemplary embodiment of the present invention.
Figure 27:
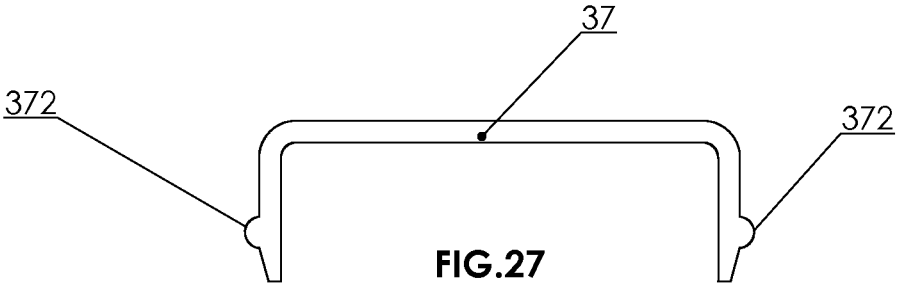
FIG. 27 illustrates a side view of another optical element 37, in accordance with an exemplary embodiment of the present invention.

FIG. 24 and FIG. 25 illustrates component 30 respectively 31, and they materialize the light diffusing/converting optical element. Alternatively, in another embodiment, the term "removable cover" is used in reference to component 30, within the scope of the invention, but not limited to that particular embodiment. Their base material could be polycarbonate. The elements 301 and 311 are layers of remote phosphor, placed near the light source. These internal surfaces might have a predefined optical profile (e.g. Fresnel lens type profile) and are co-extruded with the base material or the lens. The elements 305 and 315, depicted in two places of each component, are made of reflective materials co-extruded with the other elements. The feature 302, representing one or more indents on the side of the lens, is intended to retain the lens to the housing but in the same time allow easy snap in of the lens to the housing. In one exemplary embodiment of this invention, the feature 302 of component 30, as depicted by FIG. 24, is defined as "complementary" to feature 102 of component 10, as depicted by FIG. 28, and working as a snap-fit connection, when the two components are put together, as illustrated in FIG. 12, FIG. 13, FIG. 15, FIG. 19 or FIG. 20. Some example of "complementary" located features are groves and ribs or protrusions and indentations. The surface 304 respectively 314, is the light output surface of the light diffusing/converting optical element. FIG. 26 and FIG. 27 are examples of extruded lens profiles intended for white light L.E.D. sources. The feature 352 or 372, representing one or more indents on the side of the lens, is intended to retain the lens to the housing but in the same time allow easy snap in of the lens to the housing. In one exemplary embodiment of this invention, the feature 362 of component as depicted by FIG. 26, is defined as "complementary" to feature 132 of component 13, depicted by FIG. 28-A, and working as a snap-fit connection, when the two components are put together, as illustrated in FIG. 22. The material for these lens or for the removable cover could be made of translucent or transparent plastic materials (i.e. acrylic, polycarbonate, polycarbonate with phosphor) or other light diffusing/converting optical grade materials.

In another embodiment of this invention, the spackle flange 23 and the light diffusing element 30 could be formed as a single piece component.

The light source 70 is primarily comprised of multiple L.E.D. The technology could be blue, white, RGB L.E.D. chips. The circuit could be soft strips, FR boards, OL.E.D.s or any other electroluminescent diode that is capable of generating radiation in response to an electrical signal.

Figure 51:
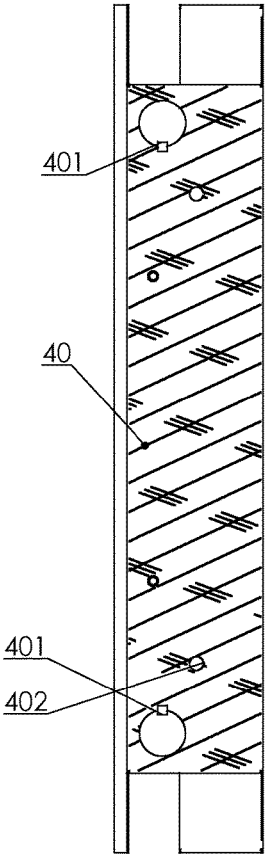
FIG. 51 illustrates a back view of component 40, named 'L.E.D. driver enclosure', in accordance with an exemplary embodiment of the present invention.

FIGS. 49, 50, 51, 52 and 53 illustrates different view angles of an L.E.D. driver enclosure (D.E.3) component 40. In FIG. 51, the feature 401 is a knockout intended to be removed if a strain relief device, like an elbow connector 46 depicted in FIG. 5, FIG. 6, FIG. 7 or FIG. 8, would need to be installed to the D.E.3 to provide power or data wires inside the enclosure. The "depth" of the driver enclosure is limited by the size of the structural elements. In an exemplary embodiment of this invention, an enclosure, mounted on a 2"×4" (2 inches by 4 inches) structural member, is considered "sufficiently recessed", if its depth, measured from its mounting surface, is less than 4 inches and its protrusions are less than the thickness of the planar surface into which it is installed.

The wiring of the L.E.D. driver enclosure (D.E.3) could be done thru any opening on the back of the enclosure ("knockout" holes, access hole and cover plate, etc.) There could be one, two or more K.O. that could receive one, two or more elbow connectors, first being to feed the power wires, a second one to feed the control wires (for example the 0-10V wires). The K.O. could be removed by pushing against the round cap from inside with a screw driver or other object having a diameter smaller than the K.O. diameter and being capable to withstand the force necessary to push the round cap until removed. The D.E.3 could be made of aluminum sheet metal or steel. The elbow could be an off the shelf item usually made of metals (zinc, steel)

Figure 52:
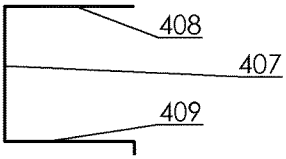
FIG. 52 illustrates a section view of component 40, taken along section line 52-52 as labeled in FIG. 49, in accordance with an exemplary embodiment of the present invention.
Figure 53:
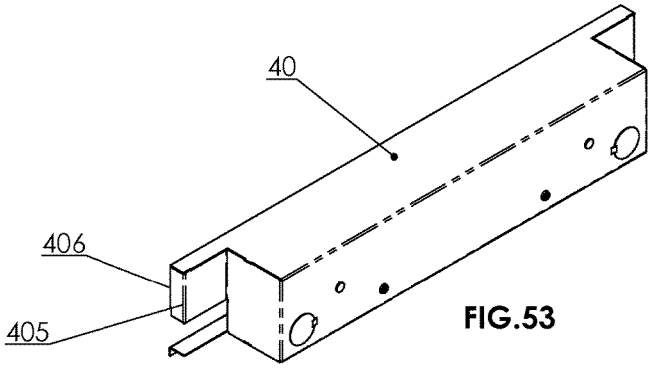
FIG. 53 illustrates an isometric view, rear perspective, of component 40 named 'L.E.D. driver enclosure', in accordance with an exemplary embodiment of the present invention.
Figure 75:
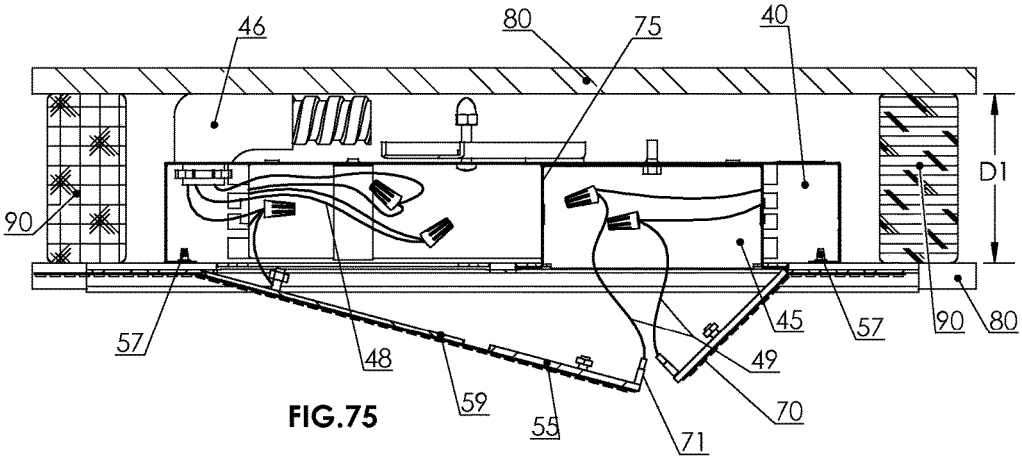
FIG. 75 illustrates a section view taken along line segment 75-75, as labeled in FIG. 73, in accordance with an exemplary embodiment of the present invention.
Figure 77:
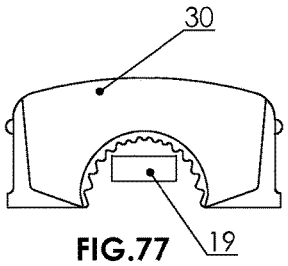
FIG. 77 illustrates a front view of a method to join consecutive optical elements 30 with a joiner piece 19, in accordance with an exemplary embodiment of the present invention.

Continuing description of features at FIG. 51, the feature 402 represents an array of half-shear or smaller K.O. features intended for easy removal when a screw and nut needs to be installed either to mount the L.E.D. driver 45 directly or thru an intermediate bracket to the D.E.3 labeled 40. The hole 403 (FIG. 50) is intended to receive a self-tapping screw 57 as depicted in FIG. 75. The screw 57 is mounting the P.I.S./H.-L.E channel segment 50 to D.E.3 component 40 and ensures electrical bonding of those two components. As illustrated in FIG. 52, the surface 407 is the back surface of D.E.3 component 40 that could serve as the mounting surface to L.E.D. driver or mounting brackets 58. Alternatively, 408 or 409 surfaces could be used to support the footprint of the driver or mounting brackets.

On the back side of the driver enclosure we can see a set of small mounting K.O. arranged in any appropriate pattern to match the footprint of a series of L.E.D. drivers intended to be installed for every fixture configuration or by using intermediate mounting bracketing. The mounting of the driver depicted in the exemplary embodiment is not intended to restrict the other options that are not shown here as this driver could be installed on the other adjacent surfaces 408 or 409 of the driver enclosure D.E.3, as seen in FIG. 52. The flange 406 would be capable to be flattened by an operator, at the fixture installation, if a wire way chase is going to be installed adjoined to the driver enclosure. The bend line 405 would be formed on a successive row of holes that are intended to weaken the strength of the flange, at the bend line, and to make easier for an operator to flatten the flange and eventually remove it by twisting that piece until its material will suffer structural damage at the bend line which would allow the flange 406 to be separated from the electrical enclosure 40.

Figure 74:
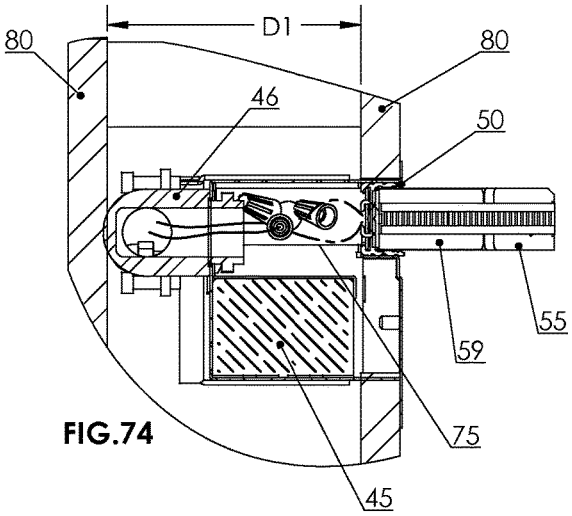
FIG. 74 illustrates a section view taken along line segment 74-74, as labeled in FIG. 73, in accordance with an exemplary embodiment of the present invention.

The enclosure 40 is considered as being "recessed" and, together with the elbow connector 46, intended to fit within the "depth" limitation of that space, labeled "D1", as depicted in FIG. 74 and FIG. 75. In general, an enclosure is considered "sufficiently recessed" if its depth, measured from its mounting surface, is less than "D1" and its protrusions are equal or less than the thickness of the planar surface "D" plus the thickness of the plaster, if any. The plaster thickness is usually between 1 mm to 6 mm. In general, the materials that are used to manufacture the electrical enclosures and the wire way chase integral to a channel, are: metals (carbon steel, stainless steel, aluminum, etc.), thermoset polyesters (i.e. fiberglass), thermoplastic (i.e. polycarbonate, ABS, etc.), polyesters, fire retardant plastics, etc.

FIG. 73, FIG. 74, FIG. 75, FIG. 76 and FIG. 76-A are illustrating D.E.3 component 40 when the access doors 55 and 59 are open for splice inspection. Soft strips connectors 71 and low voltage wires 49 are depicted in FIG. 75.

Figure 55:
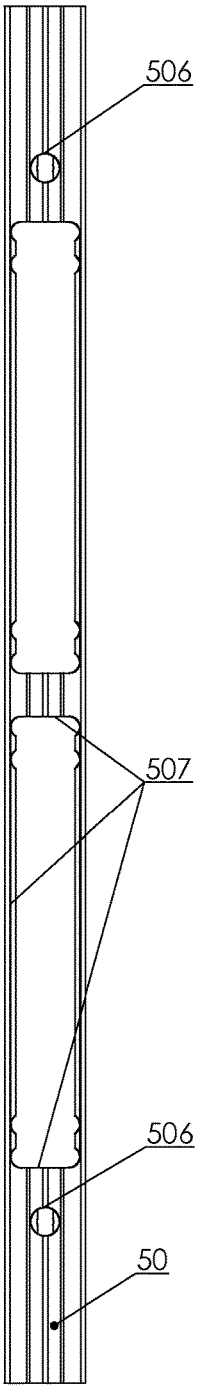
FIG. 55 illustrates a top view of component 50, named 'power input segment housing for light engine', in accordance with an exemplary embodiment of the present invention.
Figure 54:
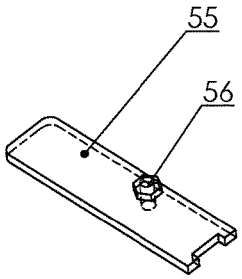
FIG. 54 illustrates an isometric view of component 55, named 'access door', in accordance with an exemplary embodiment of the present invention.
Figure 57:
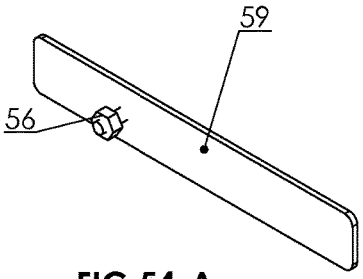
FIG. 57 illustrates a top view of component 51, named 'another power input segment housing for light engine', in accordance with an exemplary embodiment of the present invention.
Figure 57:
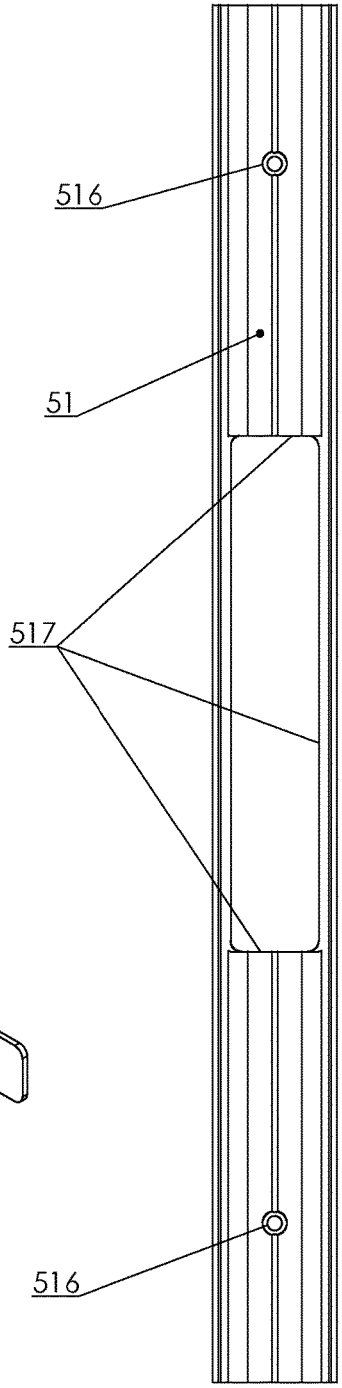
Figure 56:
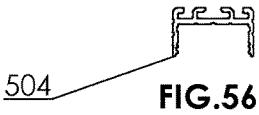
FIG. 56 illustrates a side view of component 50, named 'power input segment housing for light engine', in accordance with an exemplary embodiment of the present invention.
Figure 58:
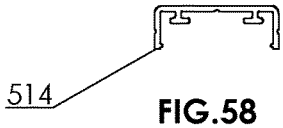
FIG. 58 illustrates a side view of component 51, named 'another power input segment housing for light engine', in accordance with an exemplary embodiment of the present invention.
Figure 59:
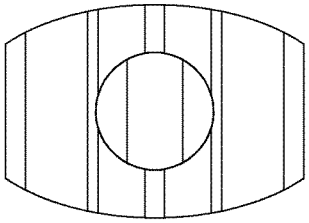
FIG. 59 illustrates a top view of mounting method of component 10, while component 18 was temporarily hidden in this view, in accordance with an exemplary embodiment of the present invention.
Figure 60:
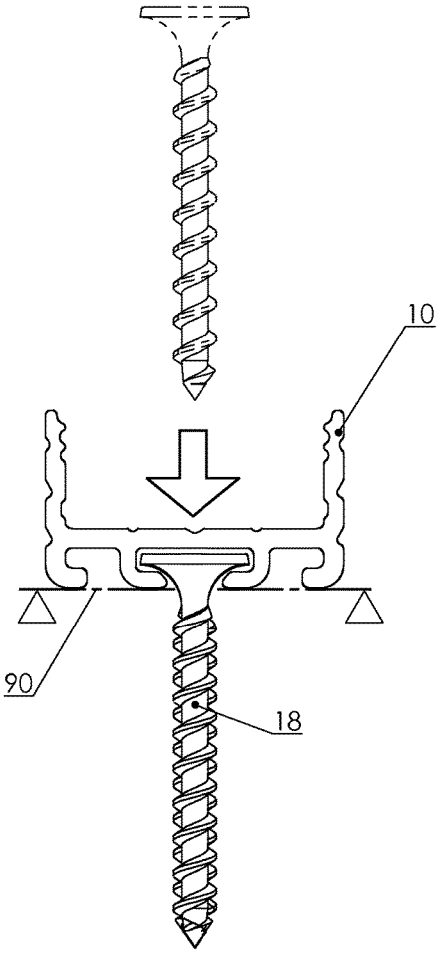
FIG. 60 illustrates a side view of mounting method of component 10, in accordance with an exemplary embodiment of the present invention.

The power input segment/housing light engine or P.I.S./H.-L.E labeled 50 as illustrated in FIG. 55 thru FIG. 58 could be made out of sheet metal aluminum or steel. Alternate construction could be made out of extruded aluminum but it would require multiple secondary operations. This segment is intended to match the profile of the extruded light engine housing 10 and ensure row continuity along the lens lines. Also, it needs to allow inspector access, from the room side, to the wire splice compartment. Also, it needs to support the light sources. As illustrated in FIG. 56 and FIG. 58, the edges 504 and 514 are highly visible and are supposed to match 101 and 201 edges of the component 10 as presented in FIG. 28 and FIG. 29. As depicted in FIG. 55 or FIG. 57, the opening for the access doors, perimeter 507 or 517 is formed as a closed loop shape, while each feature labeled 506 or 516 illustrate a countersink hole, that is intended to receive a self-tapping screw 57, on each side of the housing 50 as depicted in FIG. 75. As depicted by FIG. 75 and by FIG. 76-A, while the soft strips 70 are installed on the doors 55 and 59, the doors could be opened without removing the strips because the soft strips are flexible light engines. According to U.L. standard, a luminaire shall allow for inspection of branch circuit connections, after installation. Two minimum size openings, in the electrical enclosure, are supposed to allow passage of a rod having a diameter of ⅝" (16 mm) and these openings are covered by the access doors, in an exemplary embodiment of this invention.

Figure 12:
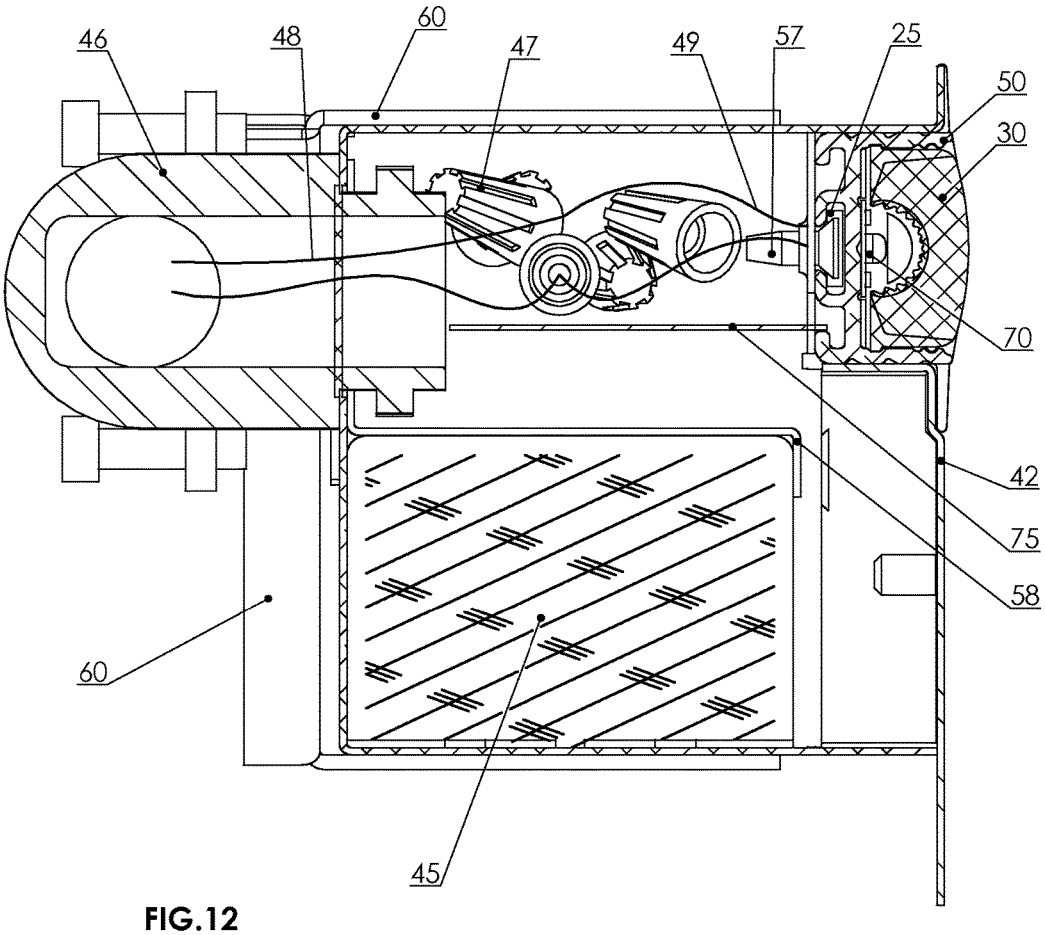
FIG. 12 illustrates section view of a line segment of the concatenated run of elongated fixtures taken along section line 12-12 as labeled in FIG. 10, in accordance with an exemplary embodiment of the present invention.

As illustrated by FIG. 12, on top of the driver compartment there is a driver access cover 42 (or its alternative 23) that could be covered with plaster during the operating time of the fixtures, for aesthetic purpose. This cover could be removed if there is a need to replace the driver inside the D.E.3.

Figure 87:
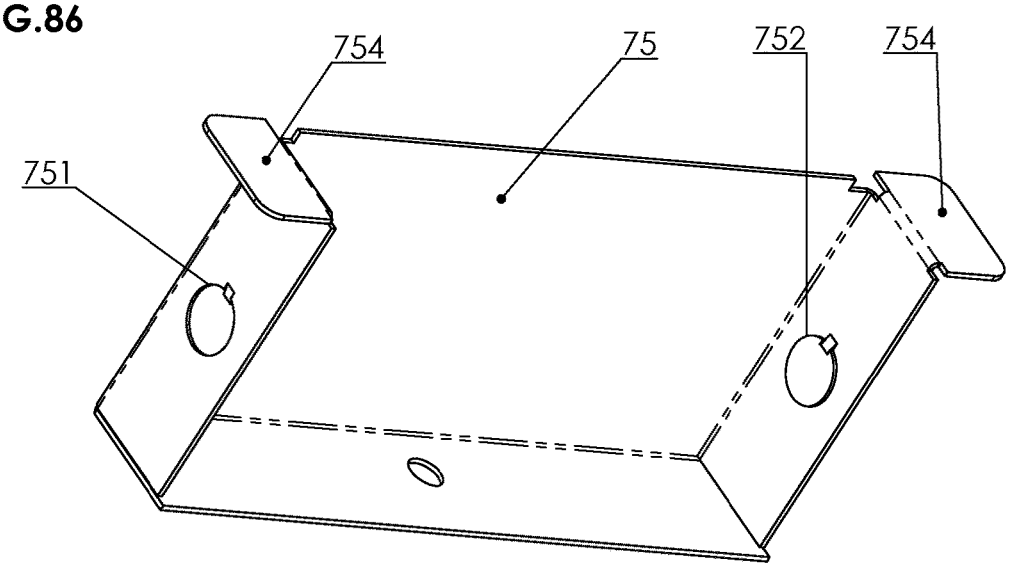
FIG. 87 illustrates a perspective view of component 75, named "internal junction box", in accordance with an exemplary embodiment of the present invention.

FIG. 84, FIG. 85, FIG. 86 and FIG. 87 are illustrating different view angles of the internal junction box, component 75. In FIG. 87, the features 751 and 752 are "knockouts", intended to be removed, as needed, to install a bushing that would allow thru-wires to be safely inserted thru this opening. These wires are to be connected inside the junction box. The feature 753 is a hole intended for a self-tapping screw that would also be installed in a hole punched in the main D.E.3, to ensure electrical bonding between the two components. The two flanges, labeled 754, are intended to cover a larger clearance slot, formed in the component 50, for removal of the internal unction box while wires are inserted thru 751 and/or 752. As illustrated by FIG. 75, the wiring compartment could be contained by an "internal junction box", component 75 that is also intended to capture the additional L.E.D. tape, the soft strip connectors, the wire nuts and wires.

Figure 63:
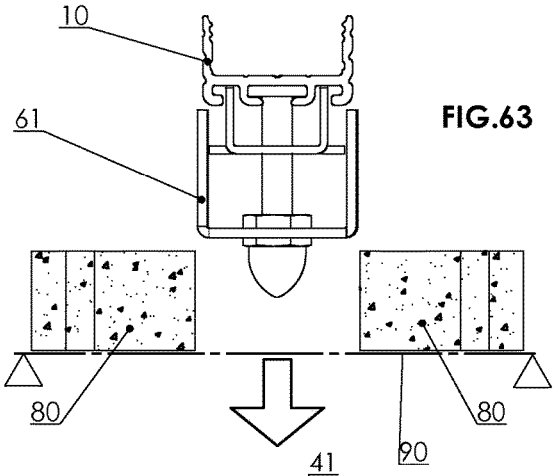
FIG. 63 illustrates a side view of a 'trim less' light engine housing 10, to be installed with rotatable bracket 61, depicted before it is about to be inserted in a gap of a planar surface 80, in accordance with an exemplary embodiment of the present invention.
Figure 66:
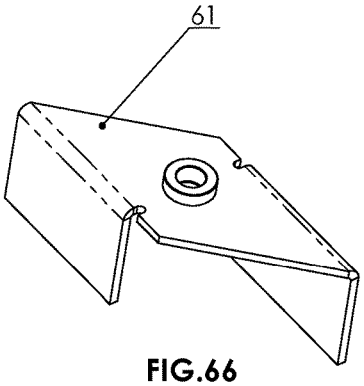
FIG. 66 illustrates a perspective view of a rotatable bracket 61, in accordance with an exemplary embodiment of the present invention.
Figure 64:
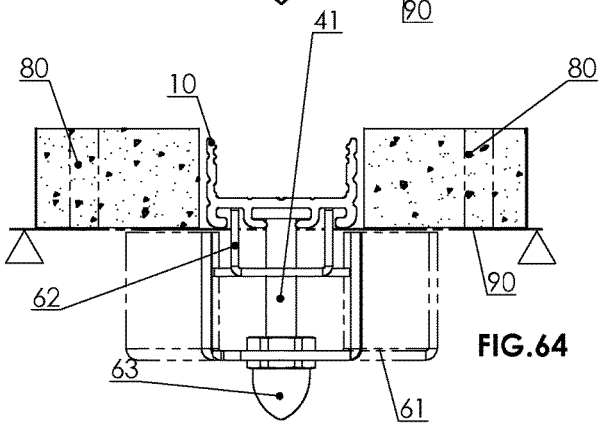
FIG. 64 illustrates a side view of a 'trim less' light engine housing and rotatable bracket 61 depicted after it was inserted in a gap of a planar surface 80, in accordance with an exemplary embodiment of the present invention.
Figure 65:
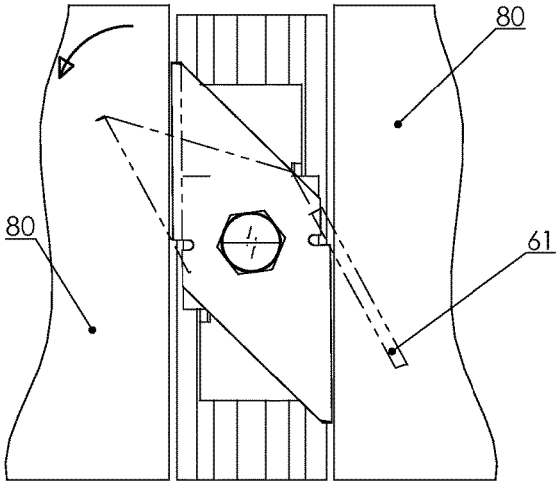
FIG. 65 illustrates a top view of a 'trim less' light engine housing and rotatable bracket 61 depicted after it was inserted in a gap of a planar surface 80, in accordance with an exemplary embodiment of the present invention.
Figure 72:
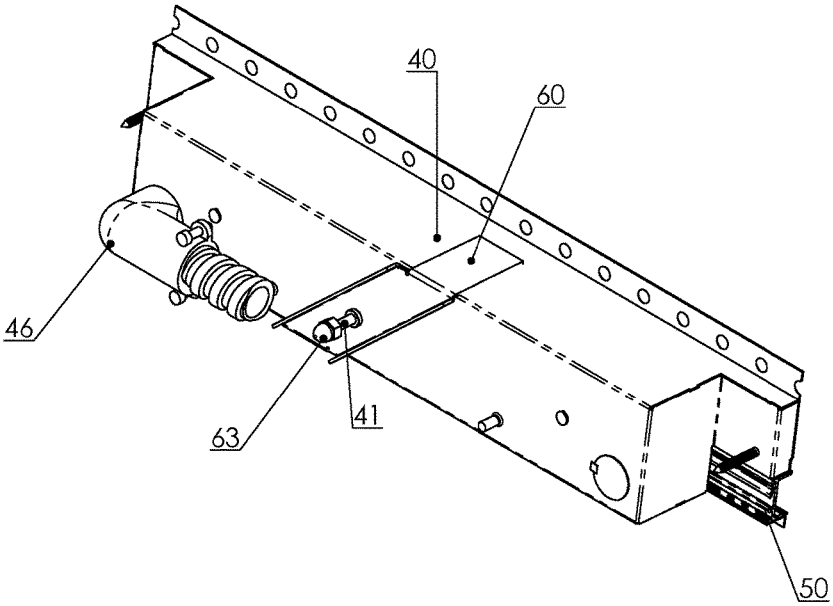
FIG. 72 illustrates an isometric view, rear perspective, of the external components attached to the back of an L.E.D. driver enclosure.
Figure 73:
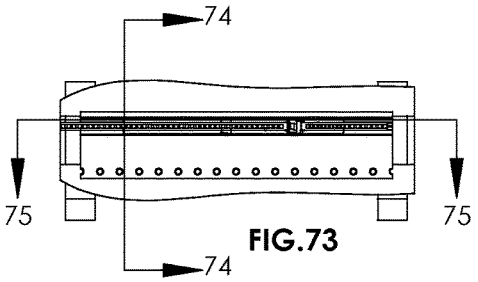
FIG. 73 illustrates a front view of a section of line segment row of fixtures installed on a planar surface, in accordance with an exemplary embodiment of the present invention.

As illustrated by FIG. 63 thru FIG. 66, the installation of the light engines to the planar surface could be done by using a rotatable bracket 61. The bracket would be positioned initially as to allow the kit to be inserted thru the gap in the planar surface 80, as illustrated in FIG. 63. Once the light engines are sitting on the structural member, the bracket could be rotated by turning the actuator screw 41. To avoid turning the screw in the wrong direction, a locking nut 63 is mounted to each actuator screw. This locking nut is preventing the loss of the rotatable brackets 60 or 61 inside of a wall, for example. Similarly, the installation of the D.E.3 compartment could be done by using a rotatable bracket 60 (FIG. 72). The component 40 would be used to stop rotation of the bracket 60, once the kit was inserted, or a bracket stop 62 could be an alternative solution.

Figure 67:
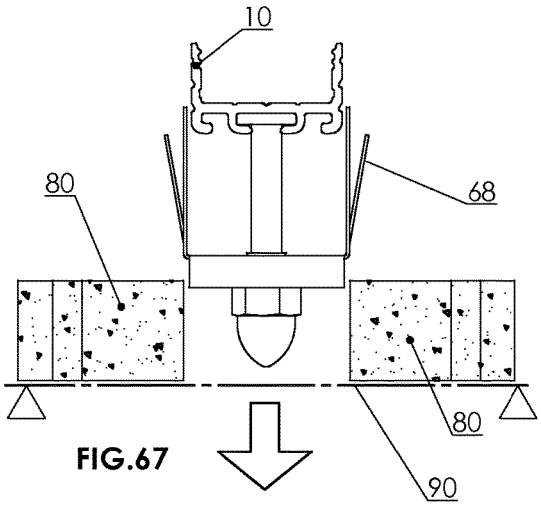
FIG. 67 illustrates a side view of a 'trim less' light engine housing 10, to be installed with slip thru bracket 68, depicted before it is about to be inserted in a gap of a planar surface 80, in accordance with an exemplary embodiment of the present invention.
Figure 68:
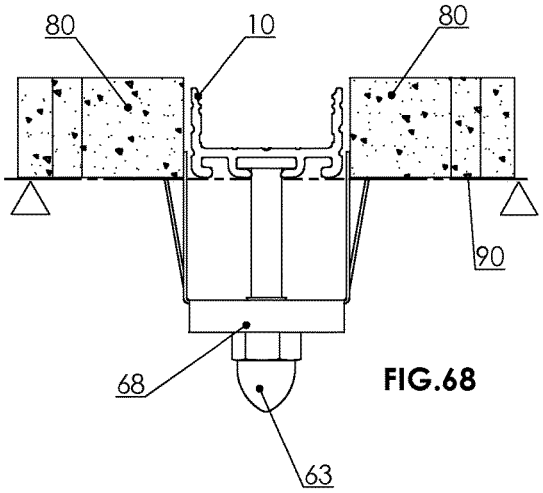
FIG. 68 illustrates a side view of a 'trim less' light engine housing 10 and slip thru bracket 68, depicted after it was inserted in a gap of a planar surface 80, in accordance with an exemplary embodiment of the present invention.
Figure 69:
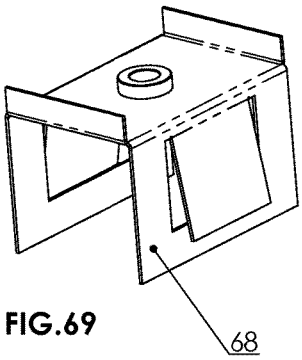
FIG. 69 illustrates a perspective view of a slip thru bracket 68, in accordance with an exemplary embodiment of the present invention.
Figure 70:
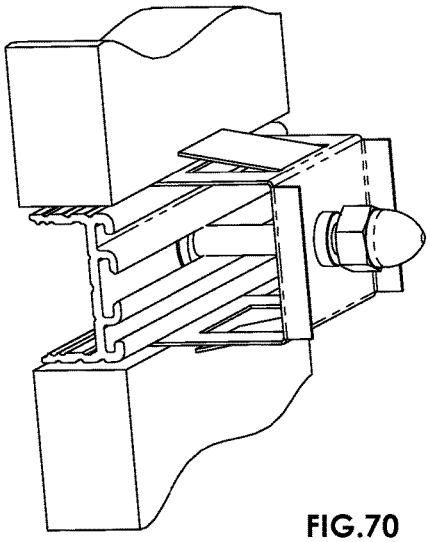
FIG. 70 illustrates an isometric view, rear perspective, of a 'trim less' light engine housing 10 and slip thru bracket 68, depicted after it was inserted in a gap of a planar surface 80, in accordance with an exemplary embodiment of the present invention.
Figure 71:
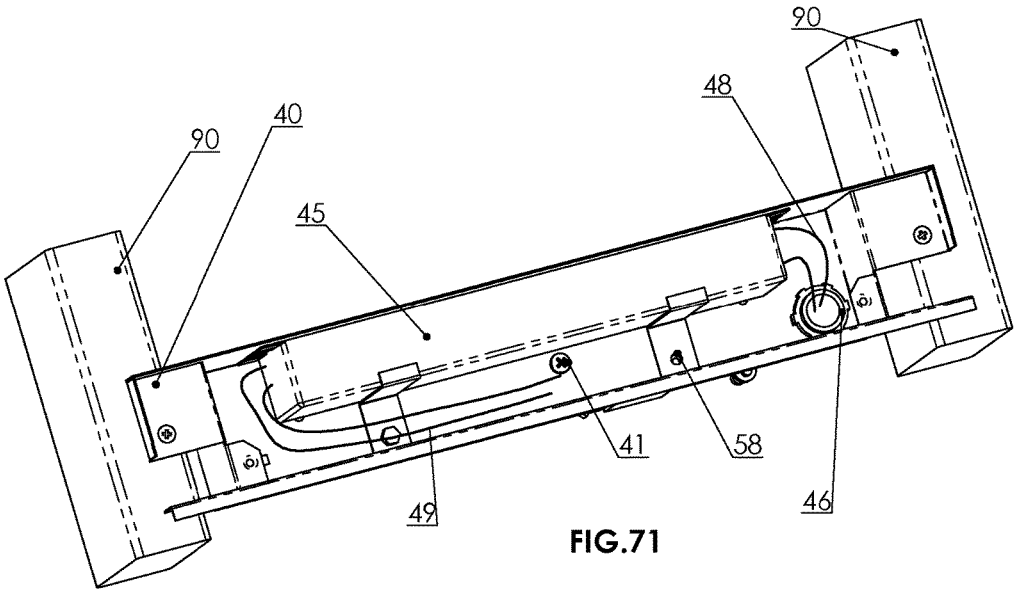
FIG. 71 illustrates an isometric view, frontal perspective, of the internal components of an L.E.D. driver enclosure, about to be installed to the frame structure.

As illustrated by FIG. 67 thru FIG. 70, the installation of the light engines to the planar surface could be done by using a slip thru bracket 68. The bracket would be inserted thru the gap in the planar surface 80, as illustrated in FIG. 67. Its flexible wings 681 would bend once it's pushed thru a small opening, in the direction of the arrow, but it would expand once it's past the small opening. This expansion to the previous state would work as a hook and it would prevent the extraction of the kit in opposite direction. Similarly, the installation of the D.E.3 compartment could be done by using a slip thru bracket.

The envelope of the fixture components installed on the framework that is supporting the architectural surface is defined as having the thickness of the respective surface, labeled "D" as illustrated by FIG. 15. In one exemplary embodiment of this invention, the dimension "D" could take values ranging between ¼ inch to 2 inches. The spakle compound 81 and 82 is applied on the planar surface 80 after the installation of a complete row of fixtures and, in some configurations, before the lens 30 and the light source 70 installation. In other configurations, the light engine 70 and the lens 30 could be installed before the spackle compound is applied. Protective tape is recommended to cover the lens if the last option was chosen. This tape should be removed before the fixture is turned on.

A section view thru the driver compartment of the lighting system is presented in FIG. 12. Most of the components description could be found in previous paragraphs except the wire nuts 47 that are used in the industry to make quick connections between solid copper wires 48.

Figure 88:
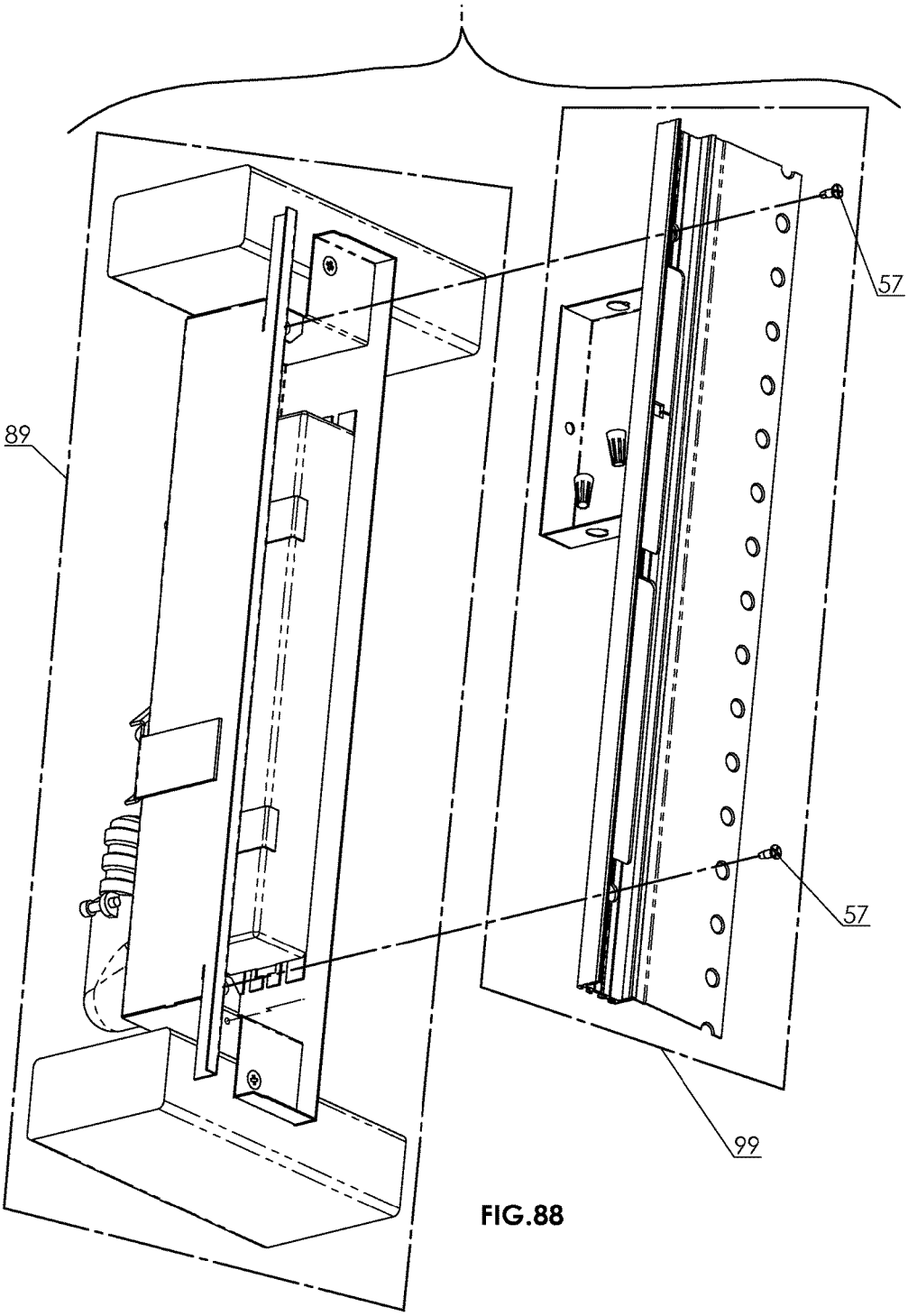
FIG. 88 illustrates an exploded view of a driver enclosure assembly, partially installed, before completion of wiring connections, in accordance with an exemplary embodiment of the present invention.

As depicted by FIG. 88, the subassembly 99 is initially separated from subassembly 889, while the operator is making the wiring connections in the junction box. The screws 57 are intended to install, bond and keep the two subassemblies together.

Figure 61:
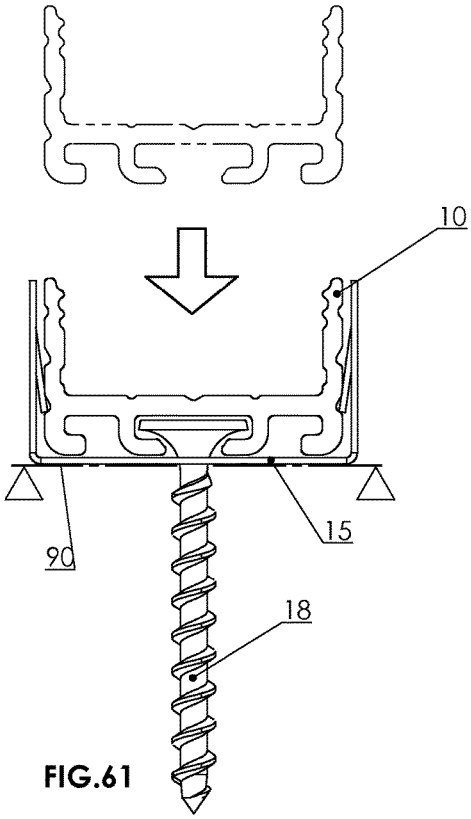
FIG. 61 illustrates a side view of another mounting method of component 10, in accordance with an exemplary embodiment of the present invention.
Figure 62:
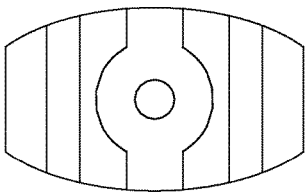
FIG. 62 illustrates a bottom view of another mounting method of component 10, while components 15 and 18 were temporarily hidden in this view, in accordance with an exemplary embodiment of the present invention.

The linear fixtures could be installed as semi-recessed configuration, where only the D.E.3 is recessed while the light engine housings are above the planar surface. Other configuration could be when the light engine housings are surface mounted (for example, using a clip 15 as seen in FIG. 61).

Figure 89:
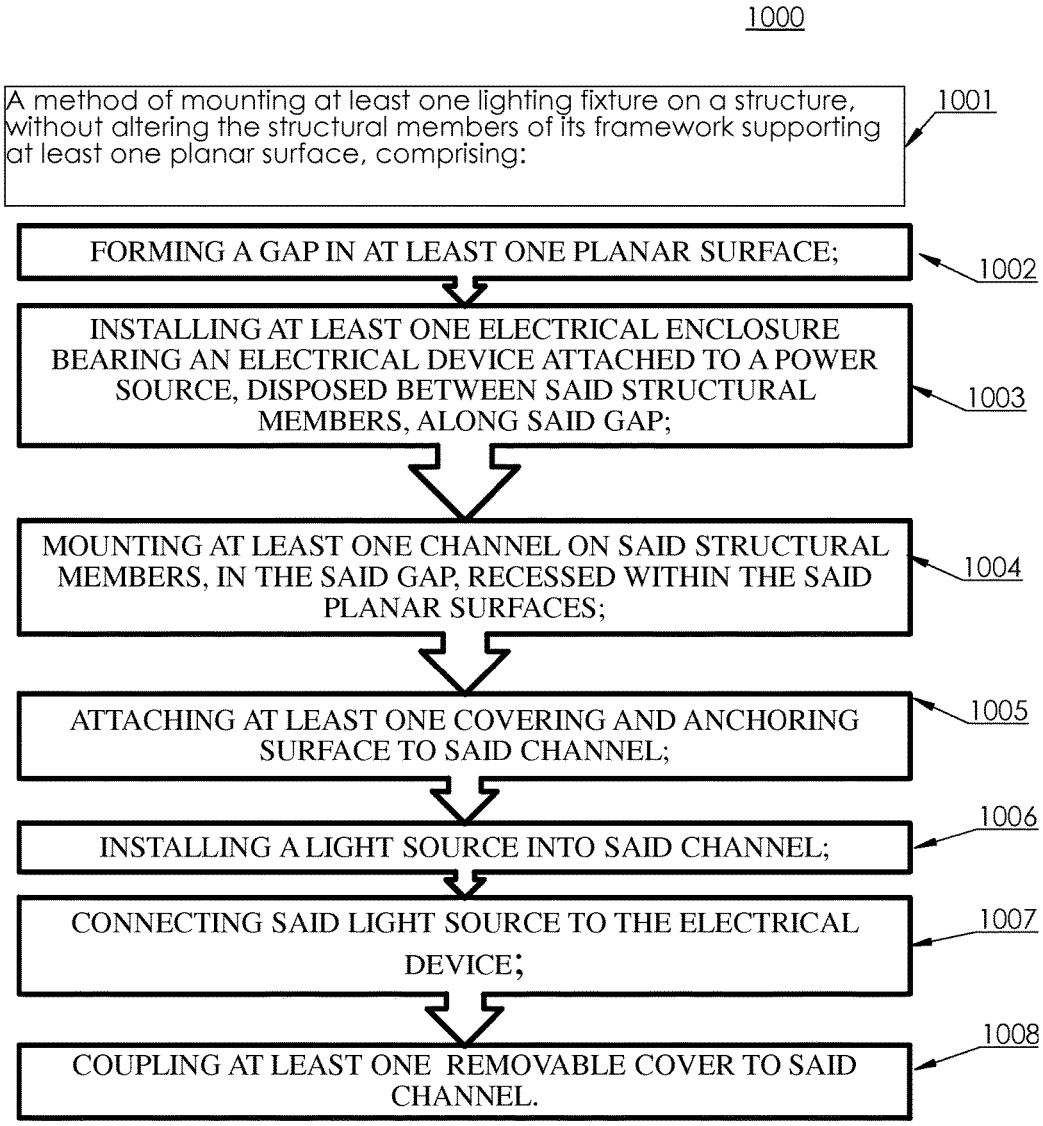
FIG. 89 illustrates a flow chart 1000 representing a method to assemble the elongated lighting fixtures, in accordance with an exemplary embodiment of the present invention.

In summary, these are the functions of the main components, or their features, as described previously:

Spackle flange 23 or covering and anchoring surface
- a) prevent particle intrusion to the integral wire way compartment of the channel housing;
- b) support the spackle/plaster compound;
- c) prevent or reduce plaster cracking;

Internal junction box 75
- a) conceal additional L.E.D. tape;
- b) contains the wire splices, wire nuts;

Electrical enclosure 40
- a) contains the L.E.D. driver and driver mounting means (brackets, screw, etc.);
- b) contains the internal junction box 75;
- c) contains "knockouts" to be removed as needed, to install elbow connector(s);

Channel/light engine housing 10
- a) prevent dirt particles to reach the reflective surface, the optical surface or the L.E.D. chips;
- b) retain the light diffusing or light converting optical element;
- c) support the L.E.D. light source and transfer the heat out of the light engine;

wire way chase 20 is intended to:
- a) protect the high voltage wire according to the safety standards;
- b) contains T-slots intended to ensure alignment of multiple channels by inserting so-called "cleats" between them;
- c) allow holes to be drilled for mounting to the structure;
- d) contains screw chase features to ensure end caps mounting;
- e) support the spackle flange;

power input segment/housing-light engine 50
- a) have an opening for the access doors;
- b) have mounting holes to attach the electrical enclosure;
- c) prevent dirt particles to reach the reflective surface, the optical surface or the L.E.D. chips;

light diffusing or light converting optical element 30
- a) convert blue light to white light;
- b) spread the incident light rays coming from L.E.D. point source to a surface illumination;

In other exemplary embodiment, depicted by the process Flow chart 1000 of FIG. 89, we define (1001) a method of mounting at least one lighting fixture on a structure, without altering the structural members of its framework supporting at least one planar surface, comprising:

a. forming a gap in at least one planar surface (1002);

b. installing at least one electrical enclosure bearing an electrical device attached to a power source, disposed between said structural members, along said gap (1003);

c. mounting at least one channel on said structural members, in the said gap, recessed within the said planar surfaces (1004);

d. attaching at least one covering and anchoring surface to said channel (1005);

e. installing a light source into said channel (1006);

f. connecting said light source to the electrical device (1007); and g. coupling at least one removable cover to said channel (1008).

Figure 90:
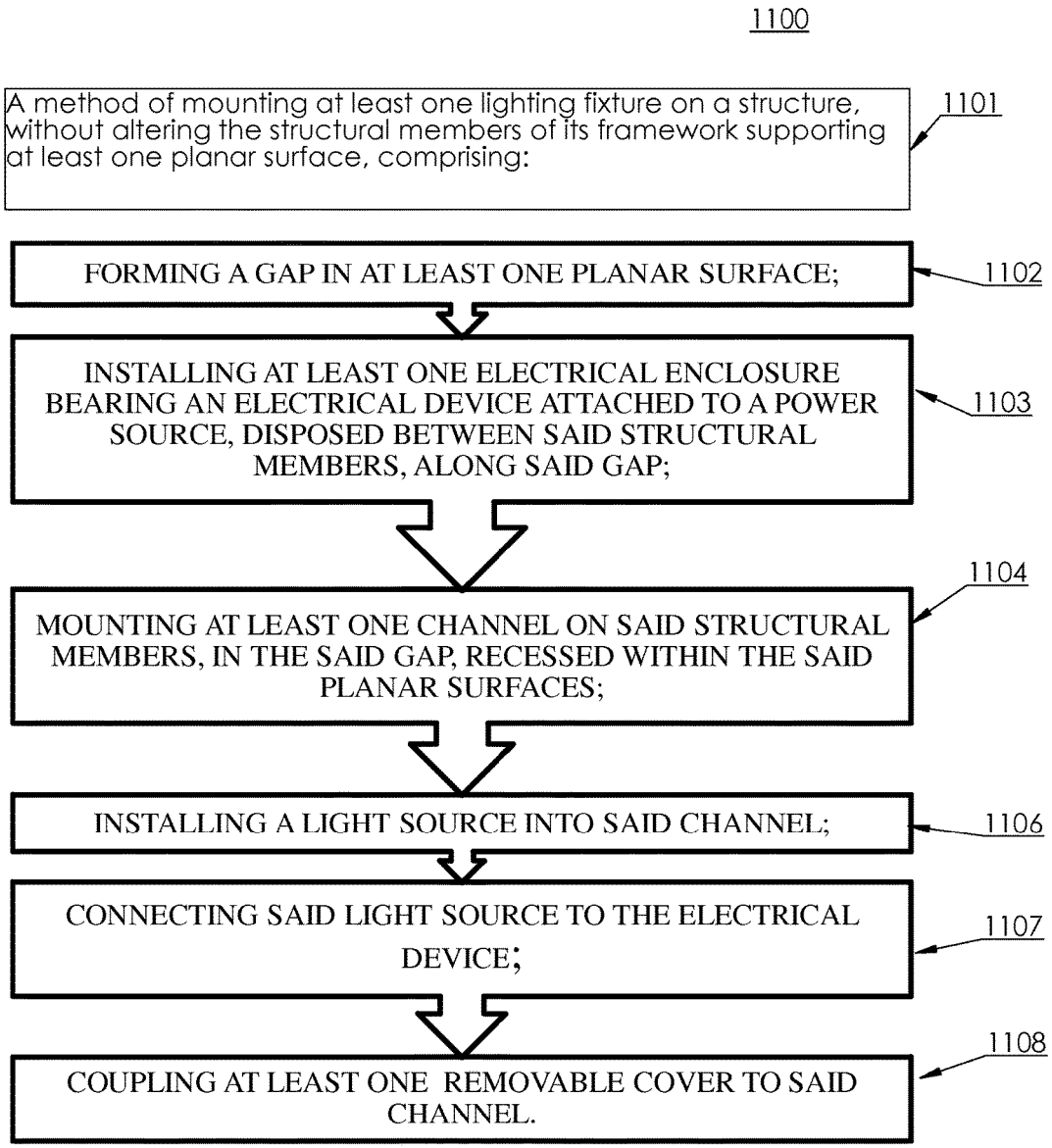
FIG. 90 illustrates a flow chart 1100 representing another method to assemble the elongated lighting fixtures, in accordance with an exemplary embodiment of the present invention.

In another exemplary embodiment, depicted by the process Flow chart 1100 of FIG. 90, we define (1101) a method of mounting at least one lighting fixture on a structure, without altering the structural members of its framework supporting at least one planar surface, comprising:

a. forming a gap in at least one planar surface (1102);

b. installing at least one electrical enclosure bearing an electrical device attached to a power source, disposed between said structural members, along said gap (1103);

c. mounting at least one channel on said structural members, in the said gap, recessed within the said planar surfaces (1104);

d. installing a light source into said channel (1106);

e. connecting said light source to the electrical device (1107); and f. coupling at least one removable cover to said channel (1108).

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. An elongated lighting fixture, intended to be installed on a structure without altering the structural members of that structure's framework, comprising:

an enclosure, mounted on at least one structural member, wherein said enclosure is sufficiently recessed behind its own mounting surface and containing an electrical device used as a power source and control;

a channel segment, adjoined said enclosure and mounted on at least one structural member bearing an opening to access said adjoining enclosure;

a junction box, adjoined to said channel segment, and located inside said enclosure;

a channel housing, abutted to and aligned with said channel segment and mounted on at least one structural member;

a wire way chase, mounted on at least one structural member, side by side and in the same direction with said channel housing;

a covering and anchoring surface for said wire way chase;

a light source, containing electroluminescent diodes, mounted in said channel segment and housing, and connected to said electrical device; and, a removable cover, mounted on said channel;

wherein said channel segment would have at least one opening for maintenance access to said power source, after said fixture installation.

2. The lighting fixture of claim 1, wherein said covering and anchoring surface is substantially level with a planar surface and capable of being plastered and painted to match the planar surface into which it is installed.

3. The lighting fixture of claim 1, wherein said removable cover is purposed for diffusion of light or alteration of light wavelength.

4. The lighting fixture of claim 1, wherein said cover is purposed to be removed for the maintenance of said light source.

5. The lighting fixtures of claim 1, wherein said channel segment, could be removed and re-installed, without damaging the surrounding finished surfaces, for maintenance or replacement of said electrical device.

6. The lighting fixture of claim 1, wherein said electrical enclosure would have at least one access door, on the channel side, for wire splice inspection and to conceal the additional L.E.D. tape, inside of said electrical enclosure.

7. The lighting fixture of claim 1, wherein said opening to access said adjoining enclosure has a hinged joint for opening an access door or a sliding plate enabling easy access to adjoining enclosure.

8. The electrical enclosure of claim 6, wherein at least one access door could be opened while the L.E.D. light source is attached to it.

9. The access door of claim 8, that could be manufactured from the same body of said channel segment, by cutting a perimeter defining its shape and leaving at least a small bridge of material that could be twisted but not cleaved when a regular force is applied by an operator with the intent to open the doors.

10. The lighting fixtures of claim 1, that is to be joined with other fixture, by at least one alignment plate.

11. The particular alignment plate of claim 10, that could have a jagged area on its first half, and a smooth zone on the second half, with one slot along each zone and a tapped hole on the smooth zone where the above plate could be press fit in an extrusion channel and travel up to a stop surface created by a second plate temporarily inserted in the slot of the smooth zone of the first alignment plate.

12. The channel of claim 1, where at least one tab (109) is formed from the body of said channel and is intended to support the access doors while they are shut and to stop them from swinging inside the electrical enclosure.

13. The lighting fixture of claim 1, wherein said channel contains a heat-conducting material.

* * * * *